US012116183B1

(12) United States Patent
Voorhees

(10) Patent No.: US 12,116,183 B1
(45) Date of Patent: Oct. 15, 2024

(54) MULTI-SCORED CORRUGATED CORNER ELEMENT

(71) Applicant: Rational Packaging LLC, Springfield, TN (US)

(72) Inventor: Samuel C. Voorhees, Louisville, KY (US)

(73) Assignee: Rational Packaging LLC, Springfield, TN (US)

( * ) Notice: Subject to any disclaimer, the term of this patent is extended or adjusted under 35 U.S.C. 154(b) by 67 days.

(21) Appl. No.: 17/982,705

(22) Filed: Nov. 8, 2022

Related U.S. Application Data

(63) Continuation-in-part of application No. 17/087,555, filed on Nov. 2, 2020, now Pat. No. 11,492,171, which is a continuation-in-part of application No. 29/667,161, filed on Oct. 18, 2018, now Pat. No. Des. 908,003, and a continuation of application No. 15/964,439, filed on Apr. 27, 2018, now Pat. No. 10,822,138, said application No. 29/667,161 is a continuation-in-part of application No. 15/964,439, filed on Apr. 27, 2018, now Pat. No. 10,822,138, and a continuation-in-part of application No. 29/593,144, filed on Feb. 6, 2017, now Pat. No. Des. 871,213, and a continuation-in-part of application No. 29/593,147, filed on Feb. 6, 2017, now Pat. No. Des. 871,908.

(51) Int. Cl.

| | |
|---|---|
| ***B65D 81/05*** | (2006.01) |
| ***B65D 5/00*** | (2006.01) |
| ***B65D 5/50*** | (2006.01) |
| ***B65D 90/00*** | (2006.01) |

(52) U.S. Cl.
CPC ..... *B65D 5/5033* (2013.01); *B65D 5/002* (2013.01); *B65D 81/053* (2013.01); *B65D 81/054* (2013.01); *B65D 90/0026* (2013.01); *B65D 2581/053* (2013.01)

(58) Field of Classification Search
CPC .... B65D 5/5033; B65D 5/002; B65D 81/053; B65D 81/054; B65D 90/0026; B65D 2581/053
USPC ..... 206/586, 521
See application file for complete search history.

(56) References Cited

U.S. PATENT DOCUMENTS 4,125,187 A * 11/1978 Vecchiotti ..... H01M 50/103 220/675
5,267,651 A * 12/1993 Hughes ..... B65D 5/5033 206/453

(Continued)

*Primary Examiner* — Steven A. Reynolds
(74) *Attorney, Agent, or Firm* — Shaddock Law Group, PC

(57) ABSTRACT

A multi-scored corrugated corner element including at least some of a portion of material; a first score mark that provides a line or portion along which the corrugated corner element may be manipulated; a second score mark formed at a spaced apart location from the first score mark that provides a line or portion along which the corrugated corner element may be manipulated; a first corner element leg extending from the first score mark to the second score mark and having one or more alternating ridges and grooves; a second corner element leg extending from the first score mark to the second corner element end and having one or more alternating ridges and grooves; and a third corner element leg extending from the second score mark to the first corner element end and having one or more alternating ridges and grooves.

20 Claims, 21 Drawing Sheets

(56) References Cited

U.S. PATENT DOCUMENTS

| | | | | |
|---|---|---|---|---|
| 5,307,928 | A * | 5/1994 | Bishop | B65D 5/5033 206/320 |
| 6,357,587 | B1 * | 3/2002 | Melms, Jr. | B65D 85/64 206/326 |
| 8,753,731 | B2 * | 6/2014 | Dunn | B65D 81/056 428/116 |
| D908,005 | S * | 1/2021 | Voorhees | D9/456 |
| 11,104,501 | B1 * | 8/2021 | Voorhees | B65D 81/127 |
| 11,577,902 | B1 * | 2/2023 | Voorhees | B65D 81/054 |
| 2005/0082200 | A1 * | 4/2005 | Robinson | B65D 81/054 206/521 |
| 2010/0133329 | A1 * | 6/2010 | Dickie | B65D 5/746 229/117.01 |
| 2010/0187153 | A1 * | 7/2010 | Simms | B65D 81/054 206/586 |
| 2011/0266177 | A1 * | 11/2011 | Lowry | B65D 19/44 53/399 |
| 2015/0136843 | A1 * | 5/2015 | Bell | B65D 5/5021 229/120.13 |

* cited by examiner

MULTI-SCORED CORRUGATED CORNER ELEMENT

CROSS-REFERENCE TO RELATED APPLICATIONS

This patent application is a continuation-in-part of U.S. patent application Ser. No. 17/087,555, filed Nov. 2, 2020, which is a continuation-in-part of U.S. patent application Ser. No. 15/964,439, filed Apr. 27, 2018, and which claims the benefit of U.S. patent application Ser. No. 29/667,161 filed Oct. 18, 2018, the benefit of U.S. patent application Ser. No. 29/593,144 filed Feb. 6, 2017, and the benefit of U.S. patent application Ser. No. 29/593,147, filed Feb. 6, 2017, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging assemblies. More specifically, the present disclosure relates to a multi-scored corrugated corner element.

2. Description of Related Art

It is generally known to use various packaging assemblies to package products for storage or shipping. Typically, packaging assemblies are constructed so as to stabilize the contained item or items and provide a certain degree of cushioning against breakage, while being moved or transported.

Depending on the size, shape, and/or weight of the contained item or items, packaging assemblies may be placed atop one another or pallets for storage, shipping, or transportation.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging assemblies and assembly components have various shortcomings. Among other things, known packaging assemblies and/or assembly components are cumbersome and have shapes that are not conducive to being packaged for shipment prior to assembly. Thus, shipping certain of the assembly components can be inefficient.

Among other things, the scored corrugated corner elements and/or scored corrugated corner elements of the present disclosure include at least one score mark formed extending substantially parallel to the longitudinal axis of the scored corrugated corner element. The score mark provides a line or portion along which the scored corrugated corner element may be bent or folded. By bending or folding the scored corrugated corner element along the score mark, a portion of the scored corrugated corner element can be urged from the formed or folded position to a more flattened position. By providing the scored corrugated corner elements in a more flattened position, the amount of space occupied by each scored corrugated corner element can be reduced and a greater number of scored corrugated corner elements can be packaged within a given shipment package.

In various exemplary, non-limiting embodiments, the scored corrugated corner elements of the present disclosure include at least some of a portion of material extending continuously, substantially parallel to a longitudinal axis, from a first terminal end to a second terminal end, wherein the portion of material extends continuously, substantially perpendicular to the longitudinal axis, from a first corner element end to a second corner element end; a vertex extending substantially parallel to the longitudinal axis, wherein the vertex is defined closer to the first corner element end than the second corner element end; a first corner element leg, extending laterally from the vertex, the first corner element leg having one or more alternating ridges and grooves, each of the alternating ridges and grooves of the first corner element leg extending substantially parallel to the longitudinal axis of the scored corrugated corner element; a second corner element leg, extending laterally from the vertex and away from the first corner element leg, the second corner element leg having one or more alternating ridges and grooves, each of the alternating ridges and grooves of the second corner element leg extending substantially parallel to the longitudinal axis of the scored corrugated corner element; and a score mark formed in the portion of material, extending substantially parallel to the longitudinal axis, wherein the score mark provides a line or portion along which the scored corrugated corner element may be bent or folded such that the scored corrugated corner element may be more easily manipulated to a more flattened position.

In various other exemplary, non-limiting embodiments, the portion of material is a sheet material.

In various other exemplary, non-limiting embodiments, a length of the first corner element leg is less than a length of the second corner element leg.

In various other exemplary, non-limiting embodiments, the score mark is formed along at least a portion of the vertex.

In various other exemplary, non-limiting embodiments, an outer wall of the scored corrugated corner element is substantially coextensive with an inner wall of the scored corrugated corner element.

In various other exemplary, non-limiting embodiments, each of the alternating ridges and grooves of the first corner element leg are alternating ridges and grooves, extending substantially parallel to the vertex.

In various other exemplary, non-limiting embodiments, each of the alternating ridges and grooves of the second corner element leg are alternating ridges and grooves, extending substantially parallel to the vertex.

In various other exemplary, non-limiting embodiments, the first corner element leg and the second corner element leg are each curvilinear along a respective length.

In various other exemplary, non-limiting embodiments, an inner wall of the first corner element leg and an inner wall of the second corner element leg comprises a sinusoidal succession of waves or curves.

In various other exemplary, non-limiting embodiments, the score mark is formed colinear with at least a portion of the vertex.

In various other exemplary, non-limiting embodiments, the score mark is formed of a complete or partial recess or depression in the portion of material.

In various other exemplary, non-limiting embodiments, the score mark is formed of a complete or partial perforation in the portion of material.

In various other exemplary, non-limiting embodiments, the score mark forms a weakened portion of the portion of material.

In various other exemplary, non-limiting embodiments, the score mark is formed of a compressed area of the portion of material.

In various other exemplary, non-limiting embodiments, the score mark is formed in a portion of an outer wall or exterior surface of the portion of material.

In various other exemplary, non-limiting embodiments, the portion of material comprises a single layer of material.

In various other exemplary, non-limiting embodiments, the portion of material comprises a multi-layer portion of material.

In various exemplary, non-limiting embodiments, the scored corrugated corner elements of the present disclosure include at least some of a portion of material extending substantially parallel to a longitudinal axis, from a first terminal end to a second terminal end, wherein the portion of material extends substantially perpendicular to the longitudinal axis, from a first corner element end to a second corner element end; a first corner element leg having one or more alternating ridges and grooves, each of the alternating ridges and grooves of the first corner element leg extending substantially parallel to the longitudinal axis of the scored corrugated corner element; a second corner element leg extending from the first corner element leg, the second corner element leg having one or more alternating ridges and grooves, each of the alternating ridges and grooves of the second corner element leg extending substantially parallel to the longitudinal axis of the scored corrugated corner element, wherein a length of the second corner element leg is greater than a length of the first corner element leg; and a score mark formed in the portion of material, wherein the score mark is formed between the first corner element leg and the second corner element leg, and wherein the score mark provides a line or portion along which the scored corrugated corner element may be bent or folded.

In various other exemplary, non-limiting embodiments, the score mark provides a line or portion along which the scored corrugated corner element may be more easily manipulated to a more flattened position.

In various exemplary, non-limiting embodiments, the scored corrugated corner elements of the present disclosure include at least some of a portion of material extending from a first terminal end to a second terminal end and from a first corner element end to a second corner element end; a vertex extending from the first terminal end to the second terminal end; a first corner element leg having one or more alternating ridges and grooves, each of the alternating ridges and grooves of the first corner element leg extending substantially parallel to the vertex; a second corner element leg extending from the first corner element leg, the second corner element leg having one or more alternating ridges and grooves, each of the alternating ridges and grooves of the second corner element leg extending substantially parallel to the vertex, wherein a length of the second corner element leg is greater than a length of the first corner element leg; and a score mark formed in the portion of material, extending from an area proximate the first terminal end to an area proximate the second terminal end, wherein the score mark is formed colinear with at least a portion of the vertex, and wherein the score mark provides a line or portion along which the scored corrugated corner element may be bent or folded.

In various exemplary, non-limiting embodiments, the multi-scored corrugated corner element of the present disclosure includes at least some of a portion of material extending continuously, substantially parallel to a longitudinal axis, from a first terminal end to a second terminal end, wherein the portion of material extends continuously, substantially perpendicular to the longitudinal axis, from a first corner element end to a second corner element end; a first score mark formed in the portion of material, extending substantially parallel to the longitudinal axis, wherein the first score mark provides a line or portion along which the corrugated corner element may be bent or folded such that the corrugated corner element may be more easily manipulated to a more flattened position; a second score mark formed in the portion of material, extending substantially parallel to the longitudinal axis, wherein the second score mark provides a line or portion along which the corrugated corner element may be bent or folded such that the corrugated corner element may be more easily manipulated to a more flattened position, wherein the second score mark is formed at a spaced apart location from the first score mark; a first corner element leg, extending between the first score mark and the second score mark, the first corner element leg having one or more alternating ridges and grooves, each of the alternating ridges and grooves of the first corner element leg extending substantially parallel to the longitudinal axis of the corrugated corner element; a second corner element leg, extending between the first score mark and the second corner element end, the second corner element leg having one or more alternating ridges and grooves, each of the alternating ridges and grooves of the second corner element leg extending substantially parallel to the longitudinal axis of the corrugated corner element; and a third corner element leg, extending between the second score mark and the first corner element end, the third corner element leg having one or more alternating ridges and grooves, each of the alternating ridges and grooves of the third corner element leg extending substantially parallel to the longitudinal axis of the corrugated corner element.

In various exemplary, non-limiting embodiments, the multi-scored corrugated corner element of the present disclosure includes at least some of a portion of material extending substantially parallel to a longitudinal axis, from a first terminal end to a second terminal end, wherein the portion of material extends substantially perpendicular to the longitudinal axis, from a first corner element end to a second corner element end; a first score mark formed in the portion of material, wherein the first score mark provides a line or portion along which the corrugated corner element may be bent or folded; a second score mark formed in the portion of material, wherein the second score mark provides a line or portion along which the corrugated corner element may be bent or folded, wherein the second score mark is formed at a spaced apart location from the first score mark; a first corner element leg, extending between the first score mark and the second score mark, the first corner element leg having one or more alternating ridges and grooves, each of the alternating ridges and grooves of the first corner element leg extending substantially parallel to the longitudinal axis of the corrugated corner element; a second corner element leg, extending between the first score mark and the second corner element end, the second corner element leg having one or more alternating ridges and grooves, each of the alternating ridges and grooves of the second corner element leg extending substantially parallel to the longitudinal axis of the corrugated corner element; and a third corner element leg, extending between the second score mark and the first corner element end, the third corner element leg having one or more alternating ridges and grooves, each of the alternating ridges and grooves of the third corner element leg extending substantially parallel to the longitudinal axis of the corrugated corner element.

In various exemplary, non-limiting embodiments, the multi-scored corrugated corner element of the present disclosure includes at least some of a portion of material extending from a first terminal end to a second terminal end and from a first corner element end to a second corner element end; a first score mark formed in the portion of material to provide a line or portion along which the corrugated corner element may be more easily manipulated; a second score mark formed in the portion of material to provide a line or portion along which the corrugated corner element may be more easily manipulated, wherein the second score mark is formed at a spaced apart location from the first score mark; a first corner element leg extending from the first score mark to the second score mark and having one or more alternating ridges and grooves extending substantially parallel to the longitudinal axis of the corrugated corner element; a second corner element leg extending from the first score mark to the second corner element end and having one or more alternating ridges and grooves extending substantially parallel to the longitudinal axis of the corrugated corner element; and a third corner element leg extending from the second score mark to the first corner element end and having one or more alternating ridges and grooves extending substantially parallel to the longitudinal axis of the corrugated corner element.

Accordingly, the present disclosure provides scored corrugated corner elements that can be easily stored in a relatively compact configuration, awaiting assembly and use.

The present disclosure separately provides scored corrugated corner elements that can be easily assembled or constructed, when needed.

The present disclosure separately provides scored corrugated corner elements that provides lower costs for handling and storage.

The present disclosure separately provides scored corrugated corner elements with a high degree of compressional strength.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
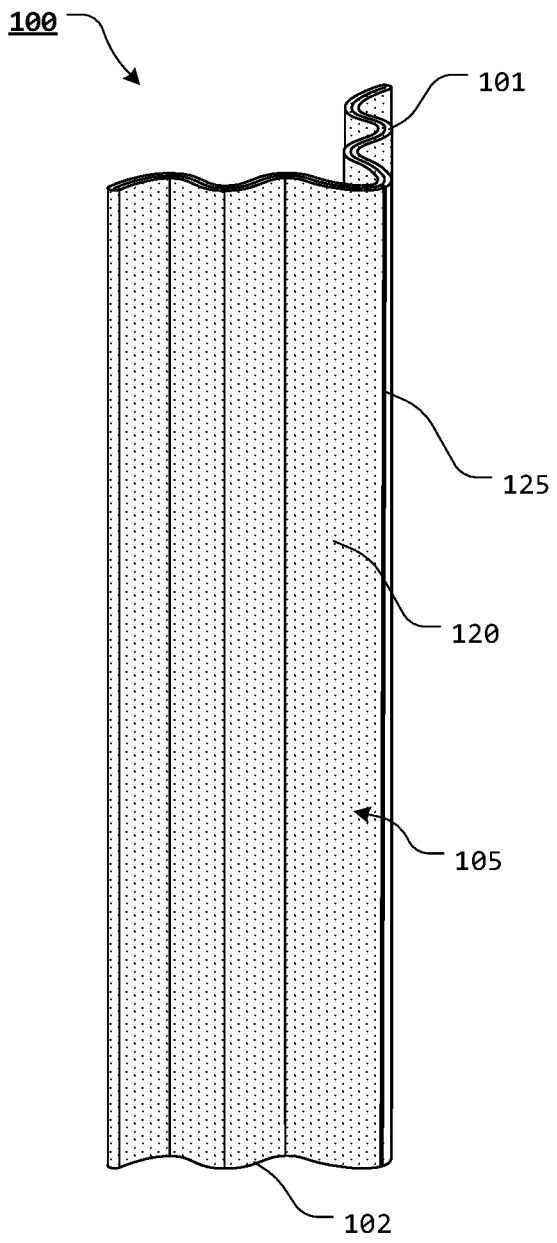
FIG. 1 illustrates a front perspective view of an exemplary embodiment of a multi-scored corrugated corner element, according to the present disclosure.
Figure 2:
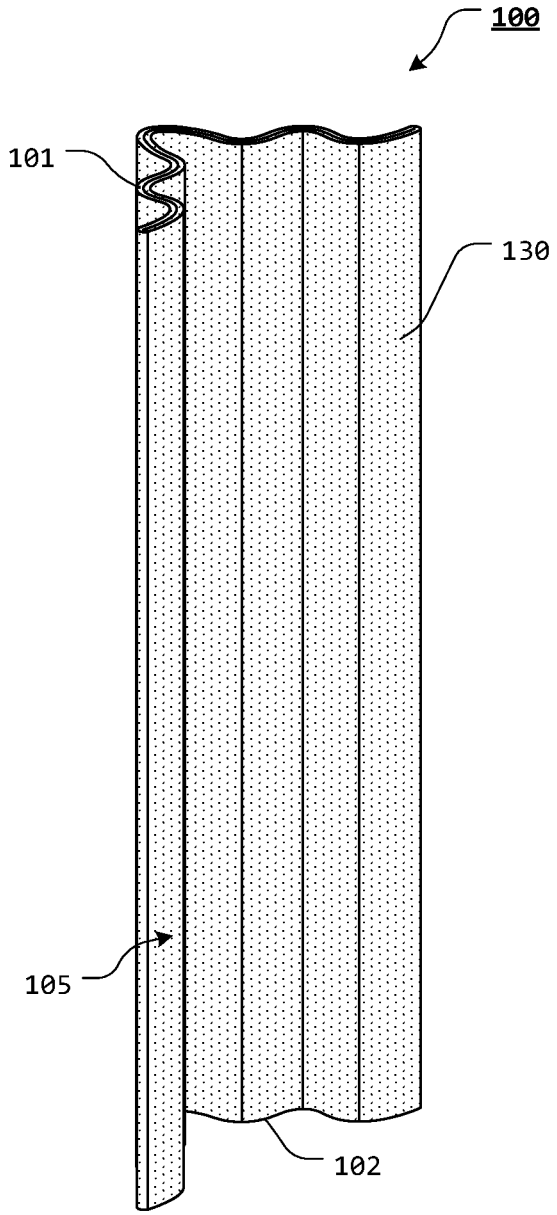
FIG. 2 illustrates a rear perspective view of an exemplary embodiment of a multi-scored corrugated corner element, according to the present disclosure.
Figure 3:
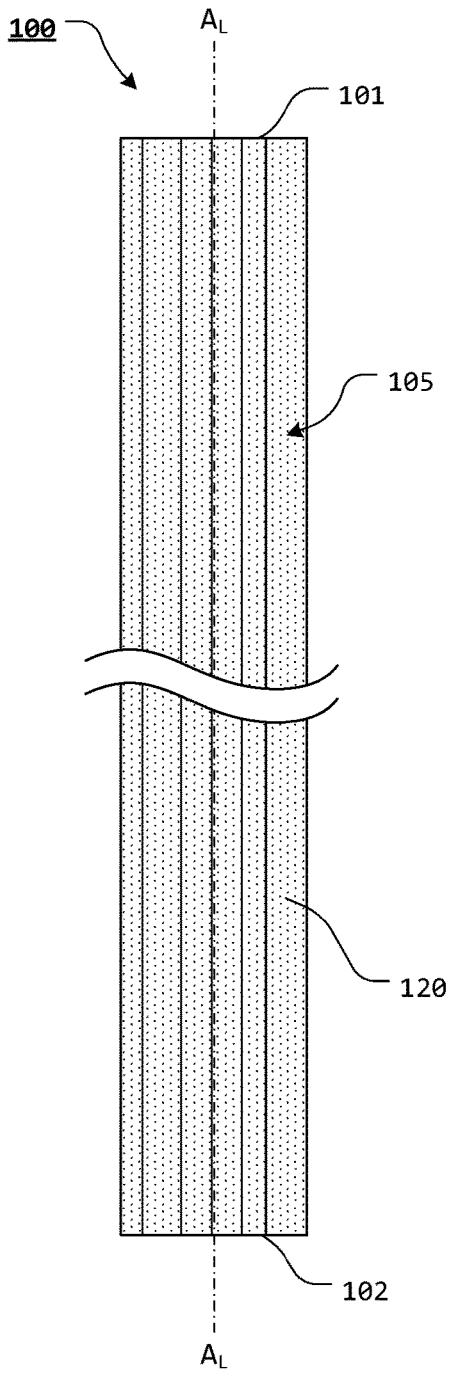
FIG. 3 illustrates a right side view of an exemplary embodiment of a multi-scored corrugated corner element, according to the present disclosure, the left side view of the exemplary embodiment of the scored corrugated corner element is a mirror image of the right side view.

For simplicity and clarification, the design factors and operating principles of the scored corrugated corner elements are explained with reference to various exemplary embodiments of scored corrugated corner elements according to the present disclosure. The basic explanation of the design factors and operating principles of the scored corrugated corner elements is applicable for the understanding, design, and operation of the scored corrugated corner elements of the present disclosure. It should be appreciated that the scored corrugated corner elements can be adapted to many applications where a packaging assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "packaging assembly", "scored corrugated corner element", "offset scored corrugated corner element", and "multi-scored corrugated corner element" are used for basic explanation and understanding of the operation of the systems, methods, and apparatuses of the present disclosure. Therefore, the terms "packaging assembly", "scored corrugated corner element", "offset scored corrugated corner element", and "multi-scored corrugated corner element" are not to be construed as limiting the systems, methods, and apparatuses of the present disclosure.

Turning now to the appended drawing figures, FIGS. 1-16 illustrate certain elements and/or aspects of exemplary embodiments of scored corrugated corner elements 100 that may optionally be used in conjunction with tray or endcap elements 200 to form a packaging assembly 300, according to the present disclosure. FIGS. 17-31 illustrate certain elements and/or aspects of exemplary embodiments of offset scored corrugated corner elements 500 that may optionally be used in conjunction with tray or endcap elements 600 to form a packaging assembly 300, according to the present disclosure. FIGS. 32-38 illustrate certain elements and/or aspects of exemplary embodiments of a multi-scored corrugated corner element 700 that may optionally be used in conjunction with tray or endcap elements to form a packaging assembly, according to the present disclosure.

In illustrative, non-limiting embodiment(s) of the present disclosure, as illustrated in FIGS. 1-16, the packaging assembly 300 comprises a plurality of scored corrugated corner elements 100 and typically two tray or endcap elements 200.

As illustrated most clearly in FIGS. 1-7, each scored corrugated corner element 100 comprises an elongate portion of material or a sheet 105 that extends, extending substantially parallel to a longitudinal axis, $A_L$, from a first terminal end 101 to a second terminal end 102. In various exemplary embodiments, the scored corrugated corner element 100 extends continuously, in an uninterrupted manner, from the first terminal end 101 to the second terminal end 102. Alternatively, one or more notches, recesses, or depressions may optionally be formed in one or more areas, along the scored corrugated corner element 100, between the first terminal end 101 and the second terminal end 102.

The portion of material or sheet 105 also extends continuously, extending substantially perpendicular to said longitudinal axis, $A_L$, from a first corner element end 128 to a second corner element end 129.

In various exemplary embodiments, each scored corrugated corner element 100 is formed of a portion of material or a sheet 105. In certain exemplary embodiments, the material used to form the sheet 105 comprises a single layer of material. Alternatively, the material used to form sheet 105 comprises multiple layers of similar or dissimilar materials joined or adhesively bonded together to form the sheet 105. Thus, it should be appreciated that the sheet 105 may comprise a single layer of material or may be a multi-layer sheet 105 formed of a laminate of a plurality of layers of material attached or coupled by an adhesive or other means.

The sheet 105 may also be formed of paperboard, chipboard, container board, box board, cardboard, or corrugated fiberboard.

A vertex 122 is defined along the scored corrugated corner elements 100. The vertex 122 generally extends, extending substantially parallel to the longitudinal axis, $A_L$, from the first terminal end 101 to the second terminal end 102. The vertex 122 defines a line from which the first corner element leg 110 and the second corner element leg 112 extend. In certain exemplary, non-limiting embodiments, the vertex 122 bisects the scored corrugated corner elements 100, extending substantially parallel to the longitudinal axis, $A_L$, proximate a center of each of the scored corrugated corner elements 100. Generally, the vertex 122 defines the furthest extent of the first corner element end 128 and the second corner element end 129, when the scored corrugated corner elements 100 is in the folded position.

The first corner element leg 110 extends continuously, laterally from the vertex 122 to a first corner element end 128, while the second corner element leg 112 extends laterally from the vertex 122 to a second corner element end 129. The second corner element end 129 extends laterally from the vertex 122, in a direction that is generally away from the direction that the first corner element end 128 extends laterally from the vertex 122.

In certain exemplary, nonlimiting embodiments, substantially straight lines from the vertex 122 to the respective first corner element end 128 and from the vertex 122 to the second corner element end 129 are at approximately 90° relative to one another, when the scored corrugated corner elements 100 is in the folded position.

Figure 4:
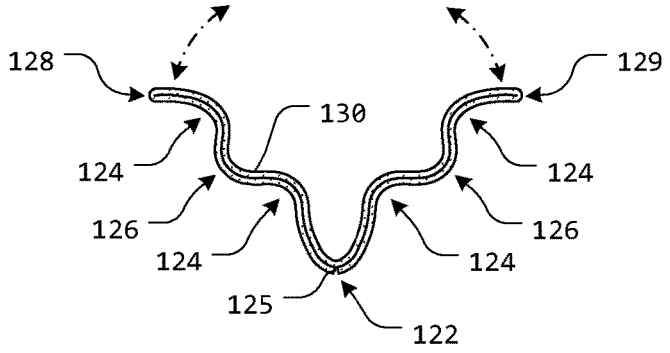
FIG. 4 illustrates a top view of an exemplary embodiment of a multi-scored corrugated corner element, according to the present disclosure.
Figure 5:
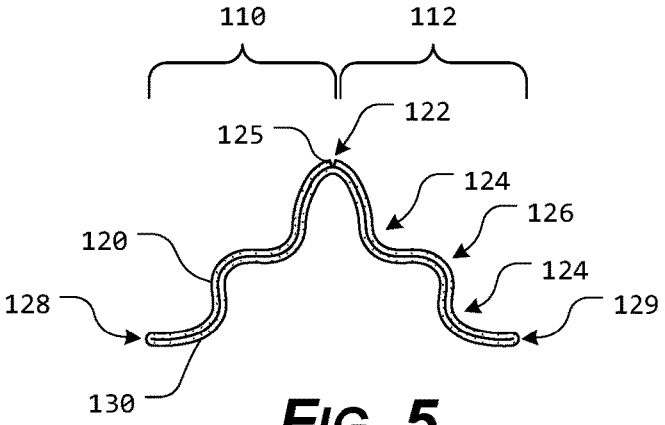
FIG. 5 illustrates a bottom view of an exemplary embodiment of a multi-scored corrugated corner element, according to the present disclosure.

Typically, when viewed from the top or the bottom, as illustrated in FIGS. 4 and 5, respectively, the first corner element leg 110 includes one or more alternating ridges 126 and grooves 124, formed along its length. Likewise, the second corner element leg 112 includes one or more alternating ridges 126 and/or grooves 124, along its length. Each of the alternating ridges 126 and grooves 124 of the first corner element leg 110 extends, extending substantially parallel to or extending substantially parallel to the longitudinal axis, $A_L$, of the scored corrugated corner elements 100. In certain exemplary, nonlimiting embodiments, each of the alternating ridges 126 and grooves 124 are extending substantially parallel and alternating ridges 126 and grooves 124.

By including the alternating ridges 126 and grooves 124, the first corner element leg 110 and the second corner element leg 112 is curvilinear along its respective length, from the vertex 122 to the respective first corner element end 128 and from the vertex 122 to the second corner element end 129. The alternating ridges 126 and grooves 124 may be formed such that the first corner element leg 110 and the second corner element leg 112 each comprise a sinusoidal succession of waves or curves, along the respective lengths, from the vertex 122 to the respective first corner element end 128 and from the vertex 122 to the second corner element end 129.

As illustrated, a transverse cross-section of the second corner element leg 112 forms a mirror image of a transverse cross-section of the first corner element legs 110. However, it should be appreciated that it is not necessary for the transverse cross-section of the second corner element leg 112 to form a mirror image of a transverse cross-section of the first corner element legs 110. Thus, a transverse cross-section of the second corner element leg 112 may have alternating ridges 126 and grooves 124 that are not mirror images of the alternating ridges 126 and grooves 124 of a transverse cross-section of the first corner element legs 110.

An outer wall 120 forms an exterior surface of the scored corrugated corner element 100, while an inner wall 130 forms and interior surface of the scored corrugated corner element 100. As used herein, the terms "outer", "exterior", "inner", and "interior" are used for reference only and are not to be viewed as limiting the present disclosure. In certain exemplary, non-limiting embodiments, the outer wall 120 of the scored corrugated corner element 100 is substantially coextensive with the inner wall 130 of the scored corrugated corner element 100.

Because of the inclusion of the alternating ridges 126 and grooves 124, the scored corrugated corner element 100 is even better able to resist top to bottom compression, extending substantially parallel to the longitudinal axis, $A_L$, of the scored corrugated corner elements 100. Additionally, the inclusion of the alternating ridges 126 and grooves 124 help each of the first corner element leg 110 and second corner element leg 112 to better resist crushing, when forces are applied to the outer wall 120 and/or the inner wall 130.

At least the vertex 122 and possibly the alternating ridges 126 and grooves 124 allow for a degree of inward flexion and resilient recovery toward the original shape of the first corner element leg 110 relative to the second corner element leg 112, as illustrated by the semicircular arrows in FIG. 4.

The structure or grain of the scored corrugated corner element 100 or the sheet 105 may make it difficult to create an even bend or fold along a portion of the scored corrugated corner element 100 or the sheet 105. Providing a score mark 125 allows the material of the scored corrugated corner element 100 or the sheet 105 to form or more easily form a bend or fold or more easily form an even or consistent bend or fold.

In certain exemplary, nonlimiting embodiments, a score mark 125, formed of a complete or partial recess or depression in the portion of material or sheet 105 or formed of a complete or partial perforation formed in the portion of material or sheet 105 extending substantially parallel to or extending substantially parallel to the longitudinal axis, $A_L$, of the scored corrugated corner element 100.

In various exemplary embodiments, the score mark 125 may be formed of a compressed area of the scored corrugated corner element 100, without creating a cut. Alternatively, the score mark 125 may be formed of a partial cut through the portion of material or sheet 105.

In certain exemplary embodiments, the score mark 125 is formed in a portion of the outer wall 120 or exterior surface of the scored corrugated corner element 100. Alternatively, the score mark 125 may optionally be formed in a portion of the inner wall 130 or interior surface of the scored corrugated corner element 100.

In certain exemplary embodiments, the score mark 125 extends from the first terminal end 101 to the second terminal end 102. Alternatively, the score mark 125 may extend from an area proximate the first terminal end 101 to an area proximate the second terminal end 102.

The score mark 125 provides a line or portion along which the scored corrugated corner element 100 may be comparatively more easily bent or folded, whether along the grain or against the grain of the scored corrugated corner element 100 or the sheet 105. Thus, the score mark 125 may optionally provide a compressed or weakened area or portion of the scored corrugated corner element 100, along which the scored corrugated corner element 100 may be comparatively more easily bent or folded.

Figure 6:
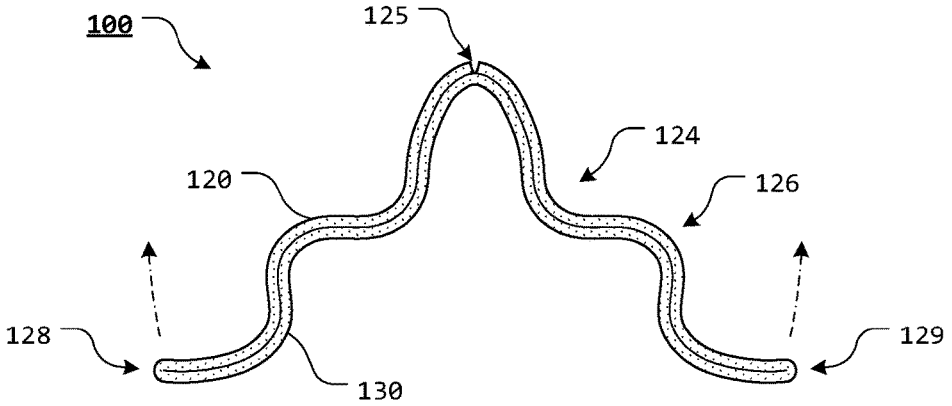
FIG. 6 illustrates a bottom view of an exemplary embodiment of a multi-scored corrugated corner element, wherein the scored corrugated corner element is in a folded position, according to the present disclosure.
Figure 7:
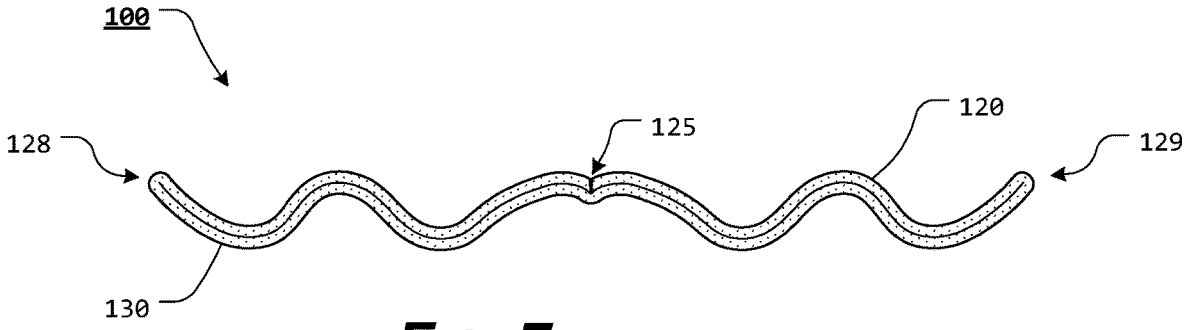
FIG. 7 illustrates a bottom view of an exemplary embodiment of a multi-scored corrugated corner element, wherein the scored corrugated corner element is in a more flattened position, according to the present disclosure.
Figure 8:
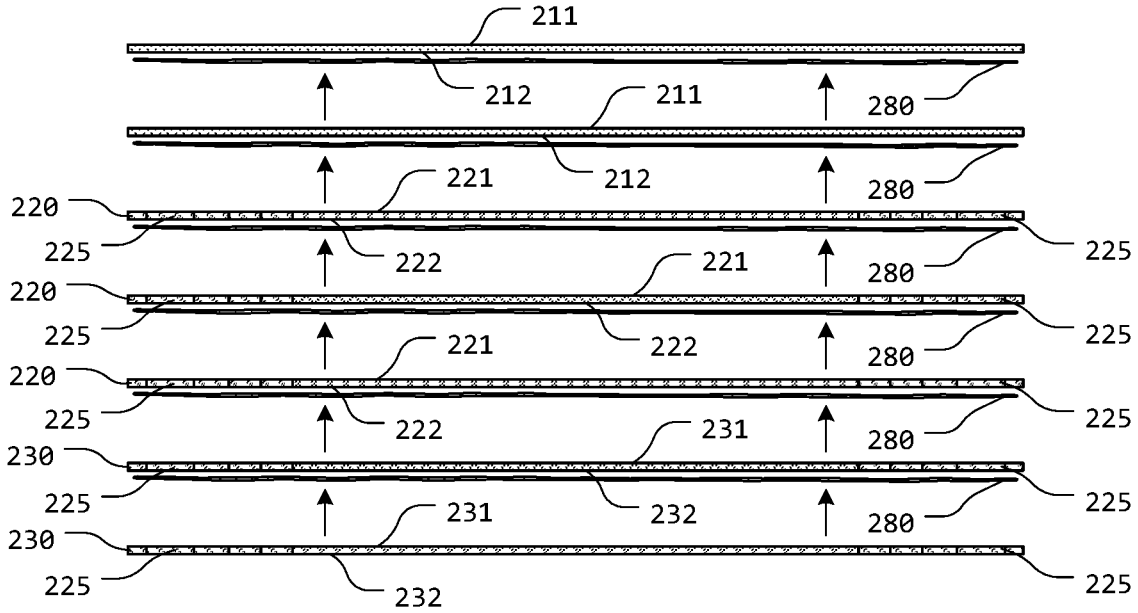
FIG. 8 illustrates a front, exploded, assembly view of an exemplary embodiment of a tray or endcap element, according to the present disclosure.
Figure 9:
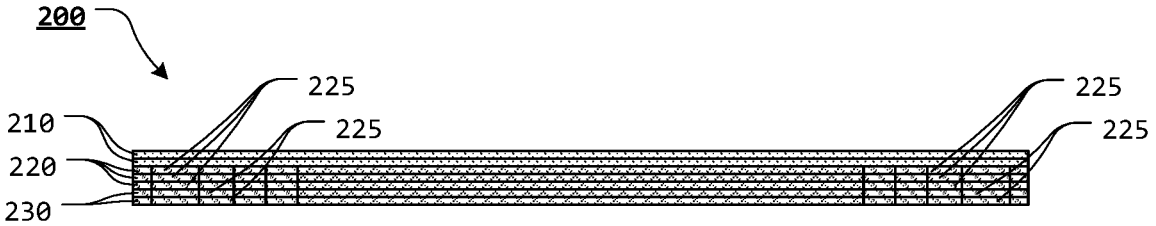
FIG. 9 illustrates a front view of an exemplary embodiment of a tray or endcap element, according to the present disclosure.
Figure 10:
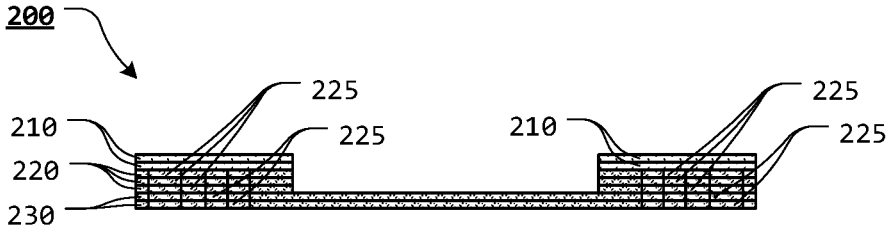
FIG. 10 illustrates a side view of an exemplary embodiment of a tray or endcap element, according to the present disclosure.
Figure 11:
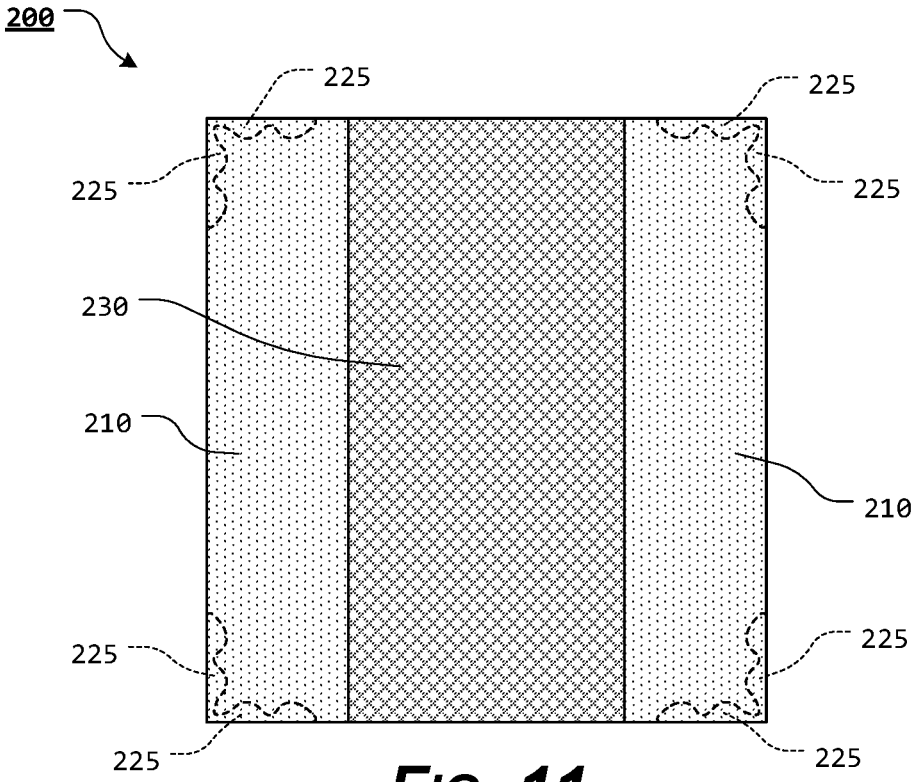
FIG. 11 illustrates a top view of an exemplary embodiment of a tray or endcap element, according to the present disclosure.
Figure 12:
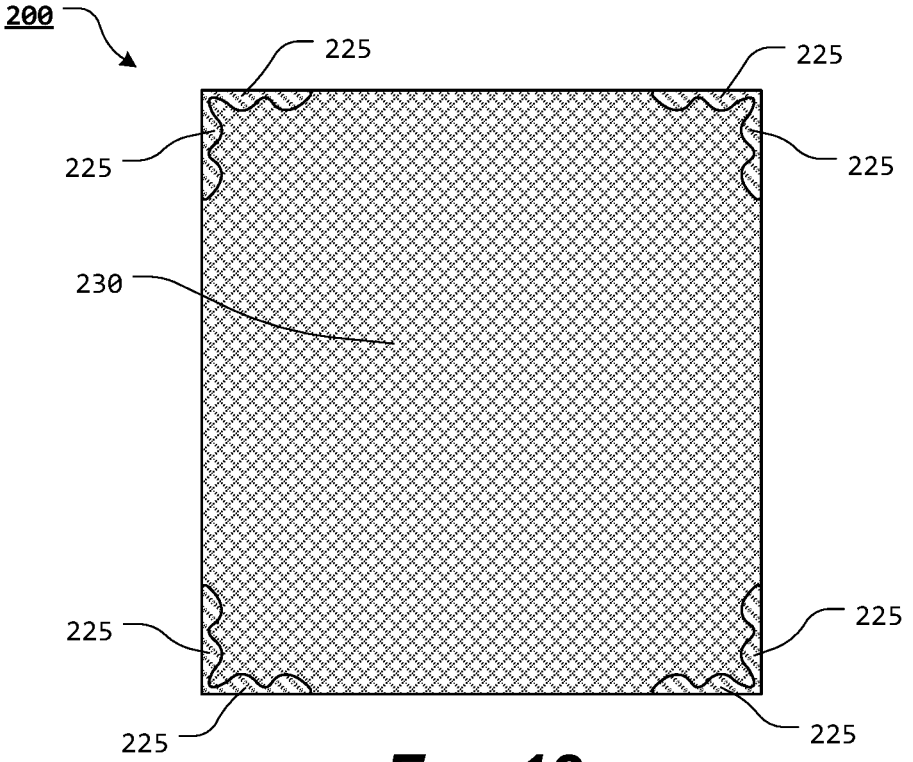
FIG. 12 illustrates a bottom view of an exemplary embodiment of a tray or endcap element, according to the present disclosure.
Figure 13:
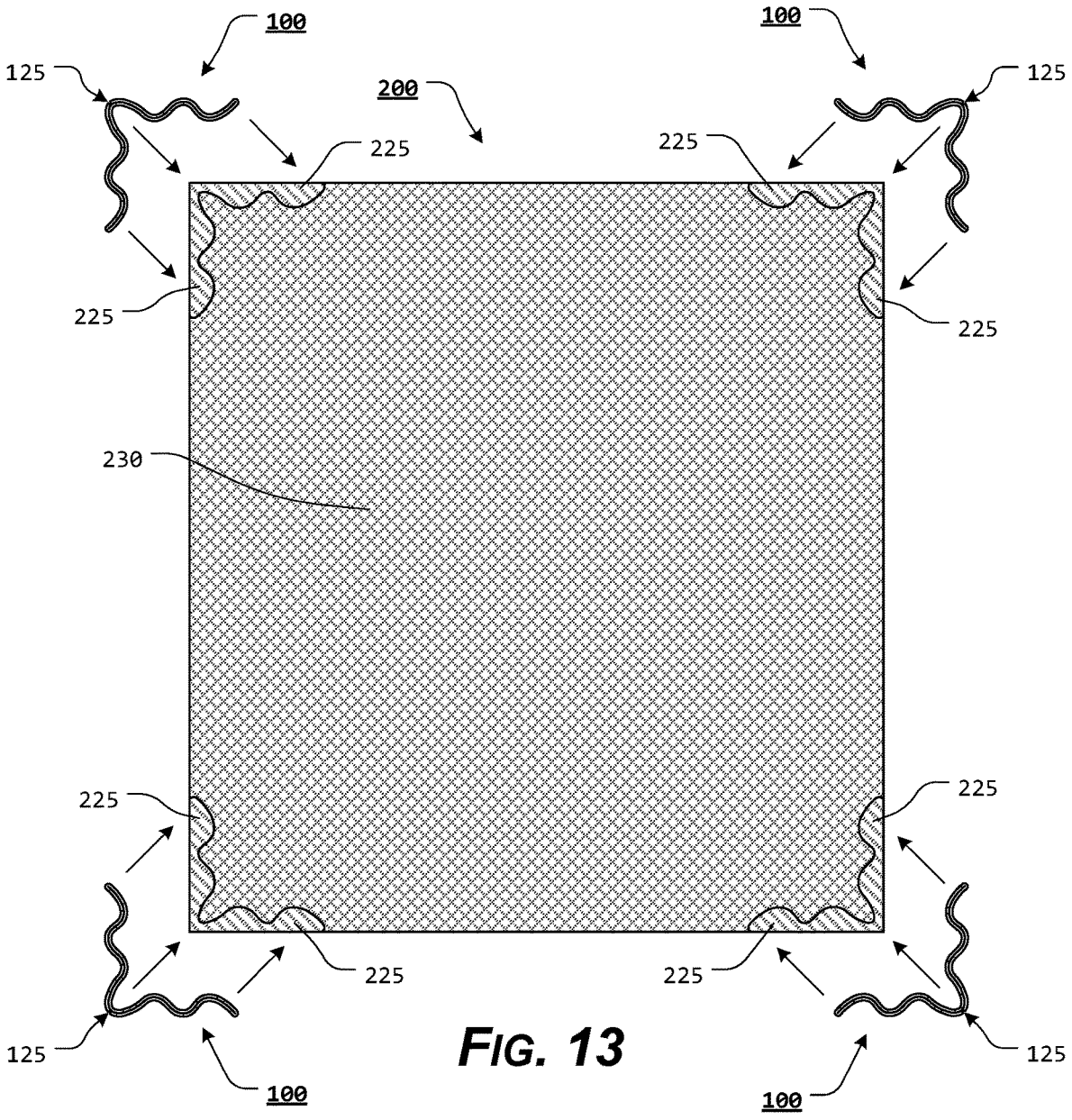
FIG. 13 illustrates a bottom view of exemplary embodiments of scored corrugated corner elements aligned with an exemplary embodiment of a tray or endcap element, according to the present disclosure.
Figure 14:
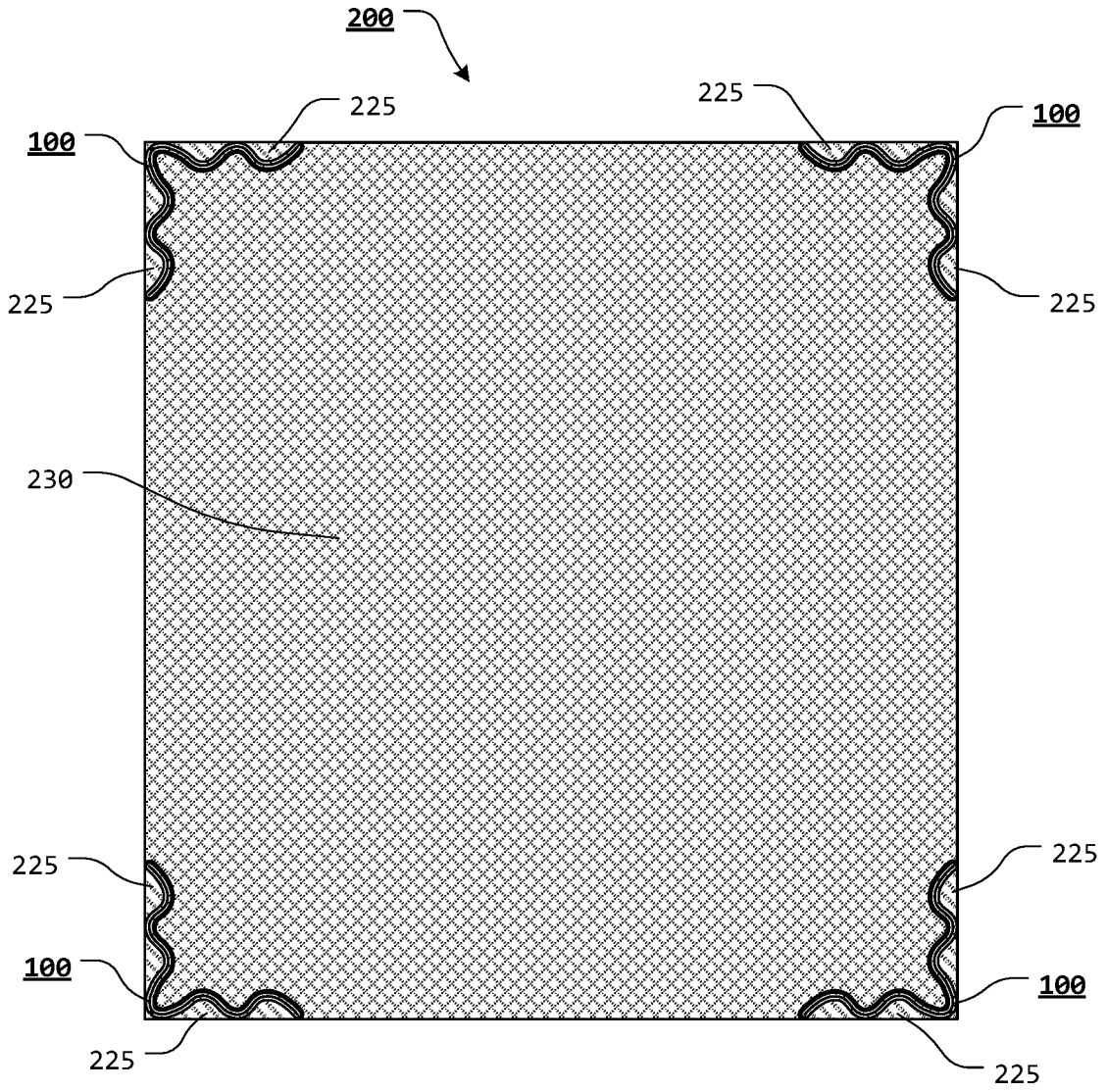
FIG. 14 illustrates a bottom view of exemplary embodiments of scored corrugated corner elements assembled with an exemplary embodiment of a tray or endcap element, according to the present disclosure.
Figure 15:
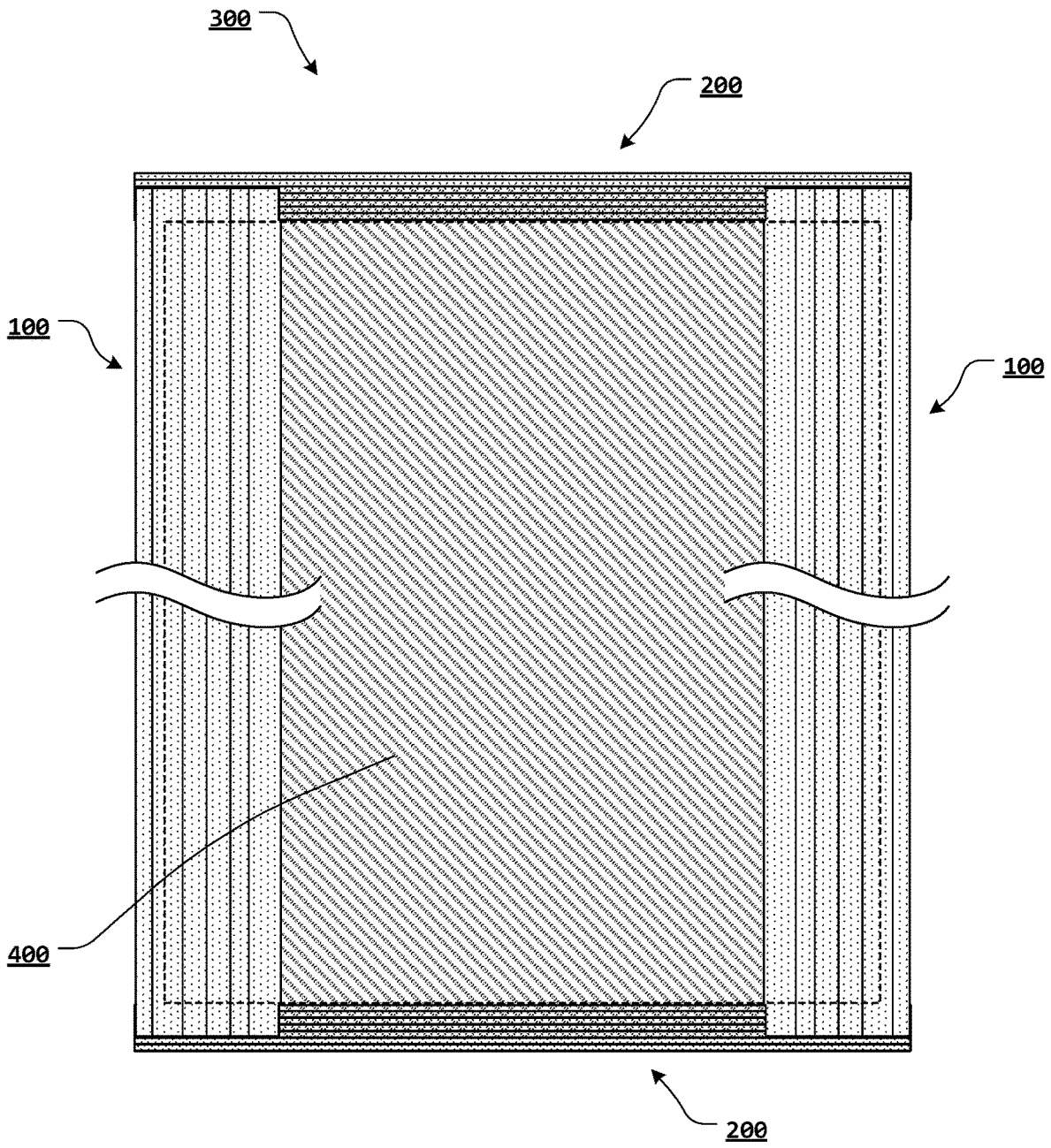
FIG. 15 illustrates a front view of exemplary embodiments of scored corrugated corner elements assembled with exemplary embodiments of tray or endcap elements, according to the present disclosure.
Figure 16:
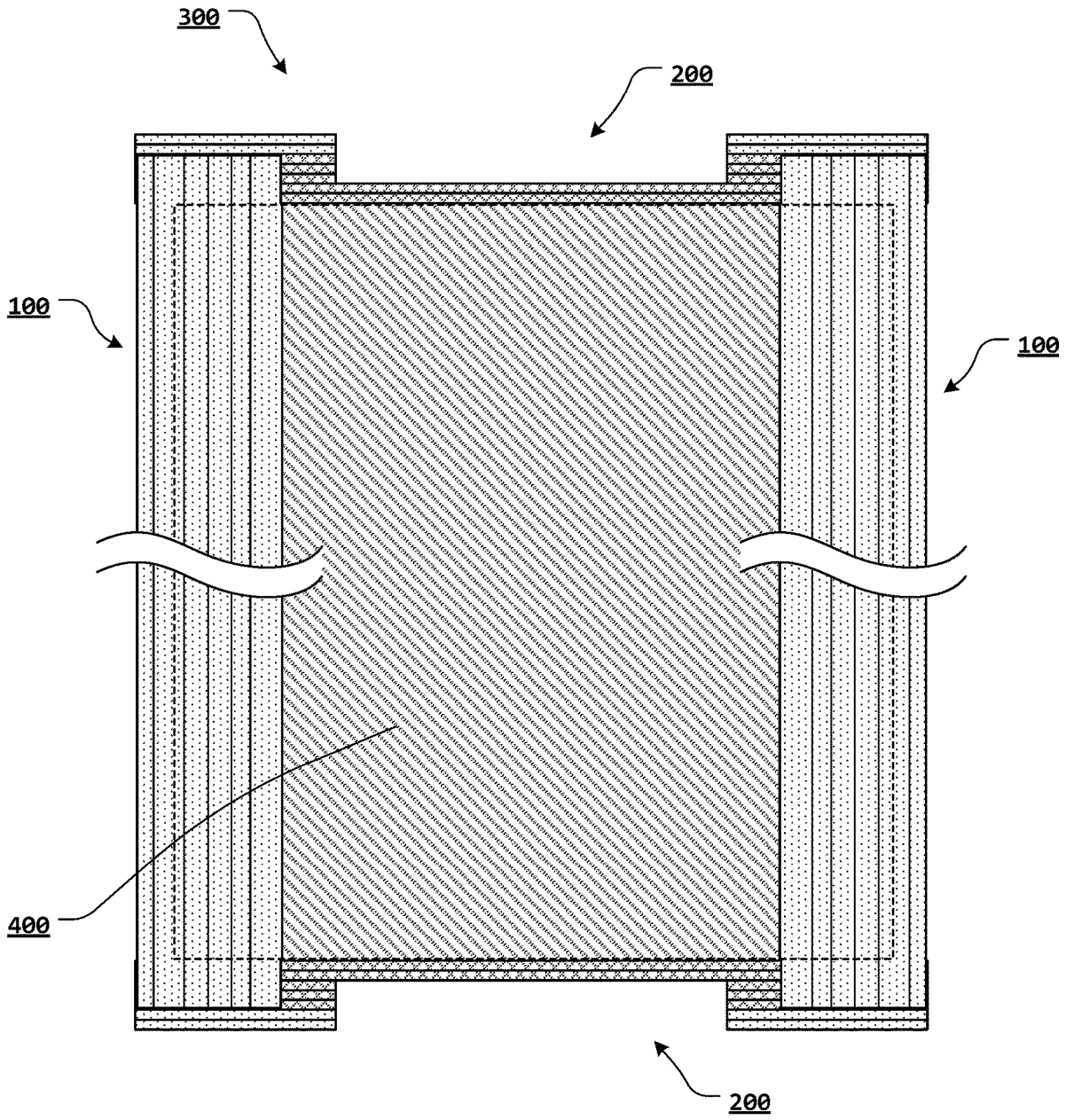
FIG. 16 illustrates a side view of exemplary embodiments of scored corrugated corner elements assembled with exemplary embodiments of tray or endcap elements, according to the present disclosure.
Figure 17:
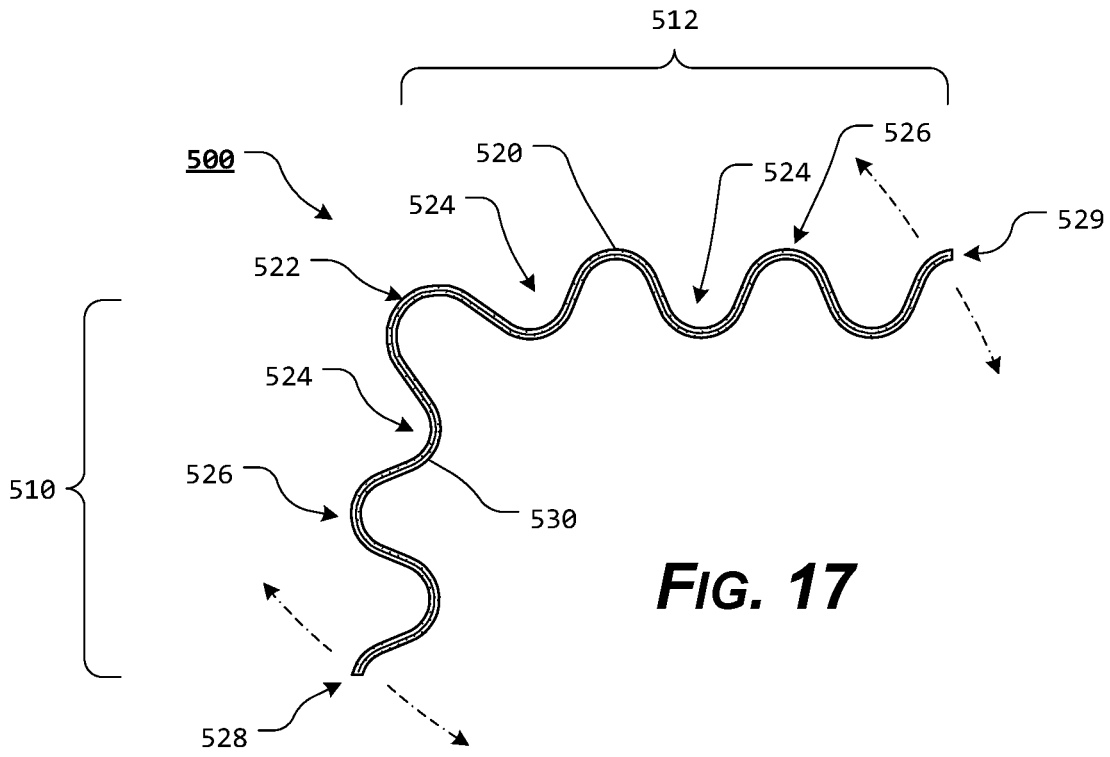
FIG. 17 illustrates a top view of an exemplary embodiment of an offset scored corrugated corner element, according to the present disclosure.
Figure 18:
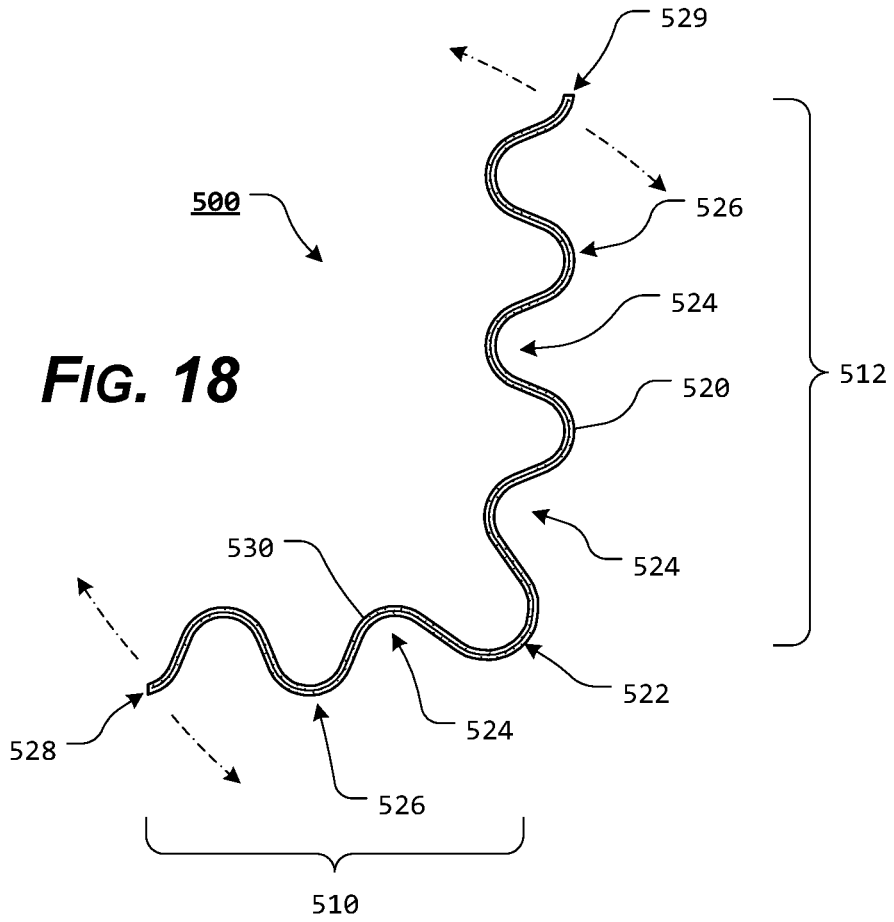
FIG. 18 illustrates a bottom view of an exemplary embodiment of an offset scored corrugated corner element, according to the present disclosure.
Figure 19:
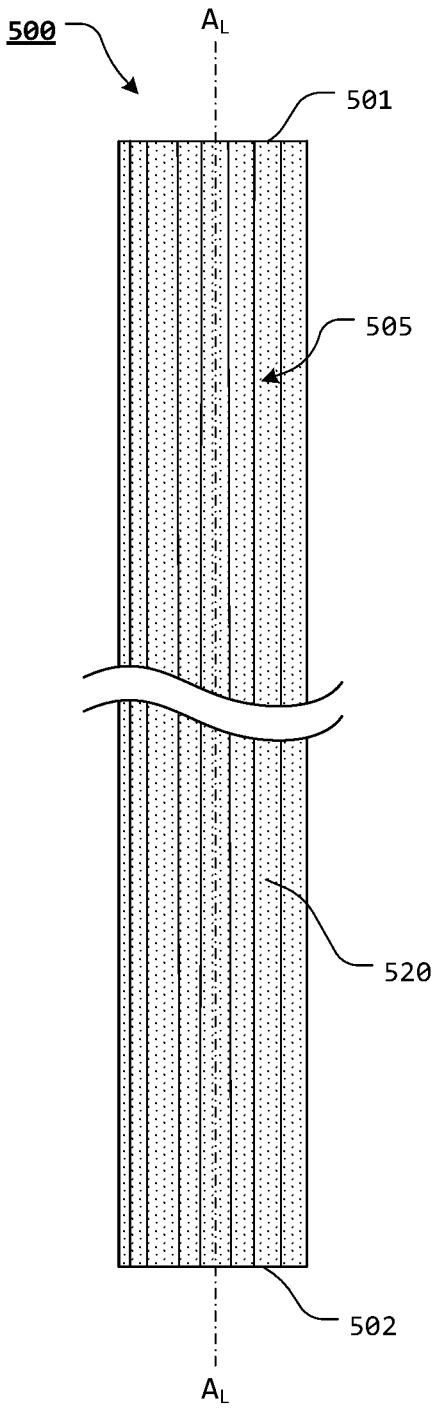
FIG. 19 illustrates a right side view of an exemplary embodiment of an offset scored corrugated corner element, according to the present disclosure.
Figure 20:
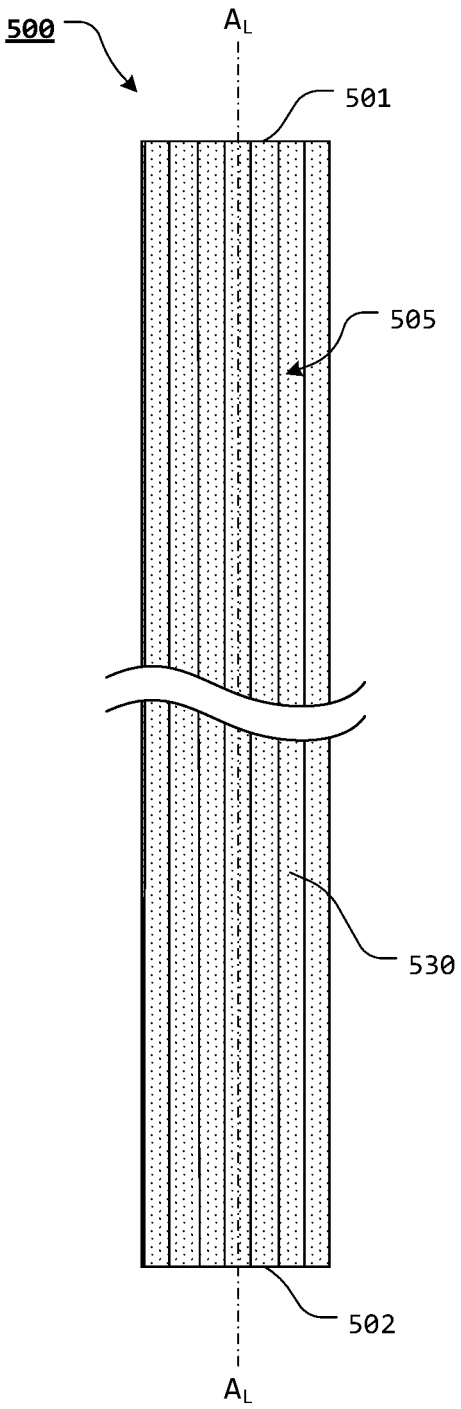
FIG. 20 illustrates a left side view of an exemplary embodiment of an offset scored corrugated corner element, according to the present disclosure.
Figure 21:
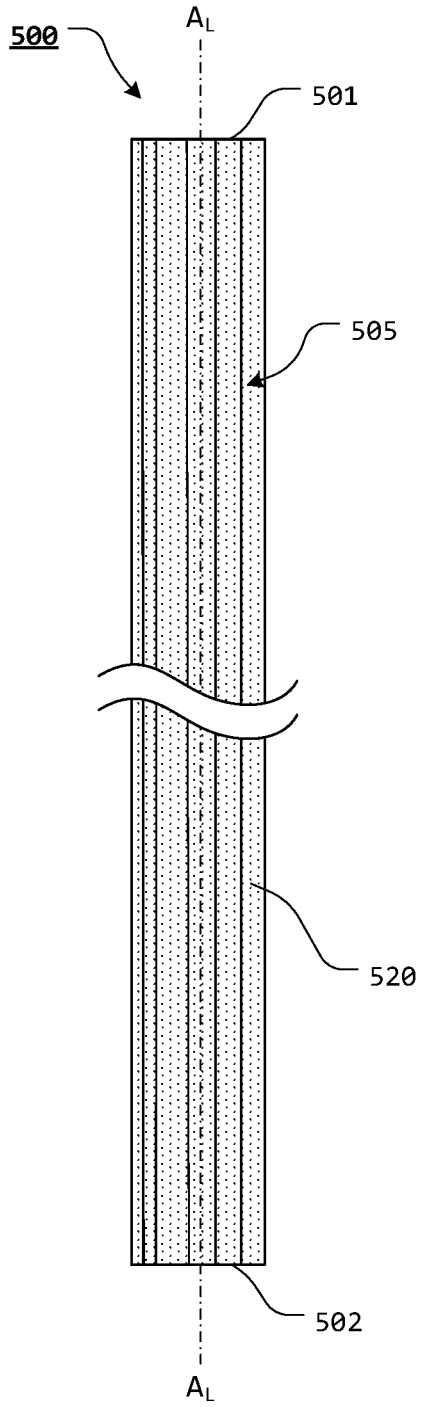
FIG. 21 illustrates a front view of an exemplary embodiment of an offset scored corrugated corner element, according to the present disclosure.
Figure 22:
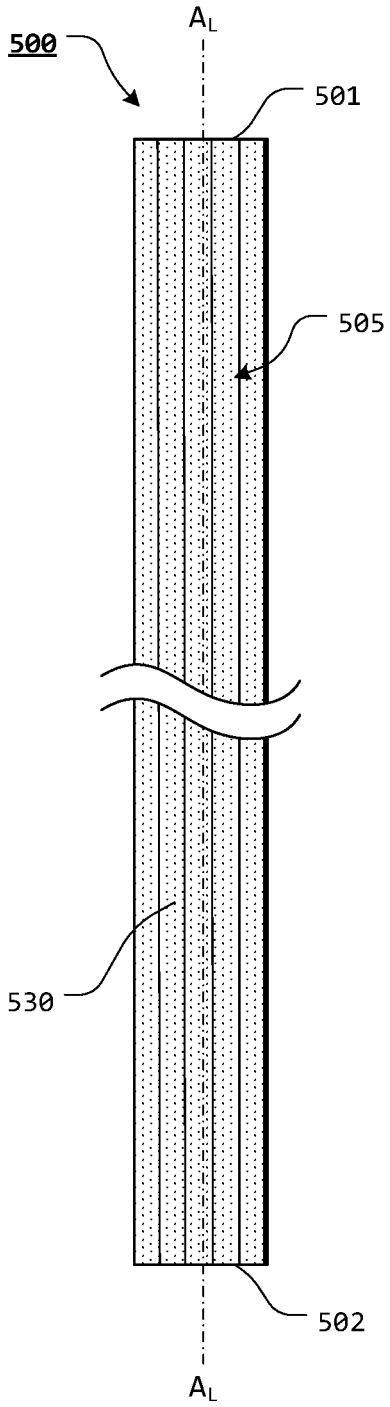
FIG. 22 illustrates a rear view of an exemplary embodiment of an offset scored corrugated corner element, according to the present disclosure.
Figure 23:
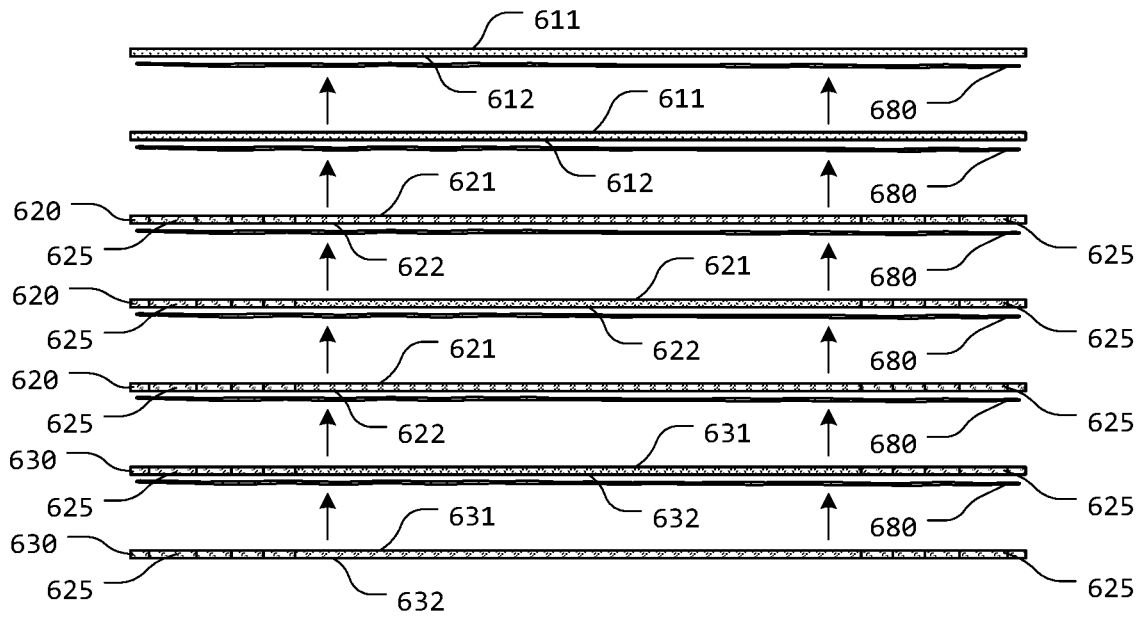
FIG. 23 illustrates a front, exploded, assembly view of an exemplary embodiment of a tray or endcap element, according to the present disclosure.
Figure 24:
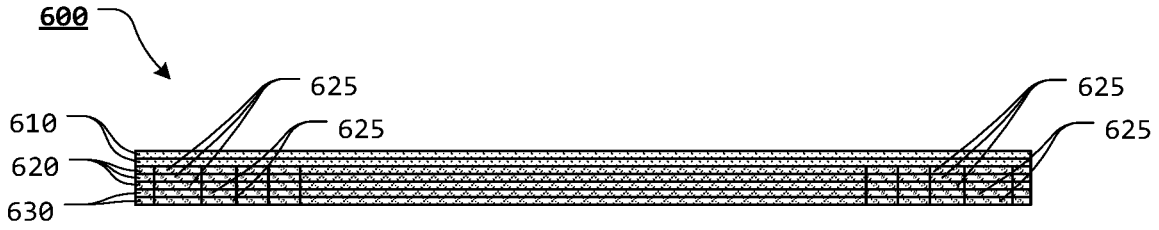
FIG. 24 illustrates a front view of an exemplary embodiment of a tray or endcap element, according to the present disclosure.
Figure 25:
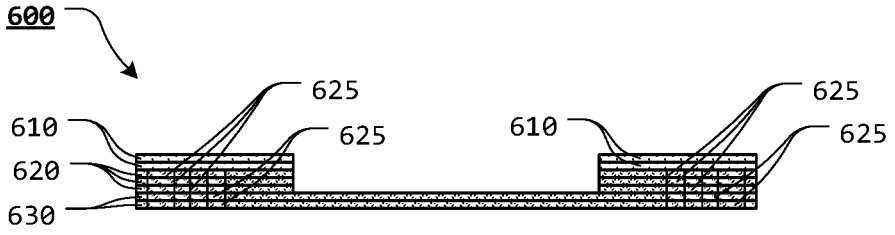
FIG. 25 illustrates a side view of an exemplary embodiment of a tray or endcap element, according to the present disclosure.
Figure 26:
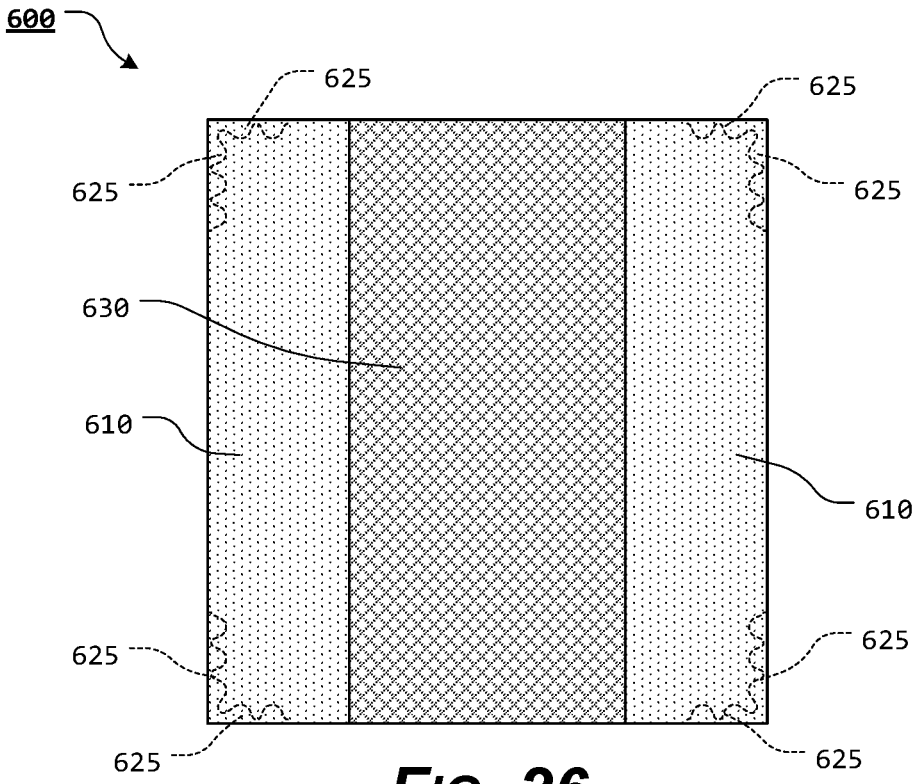
FIG. 26 illustrates a top view of an exemplary embodiment of a tray or endcap element, according to the present disclosure.
Figure 27:
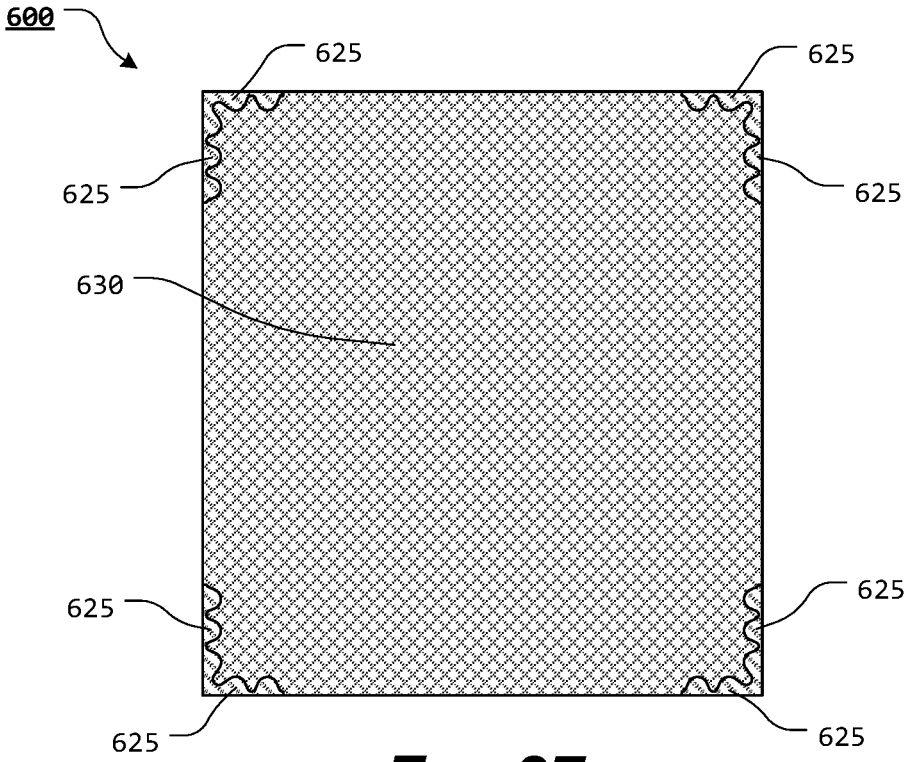
FIG. 27 illustrates a bottom view of an exemplary embodiment of a tray or endcap element, according to the present disclosure.
Figure 28:
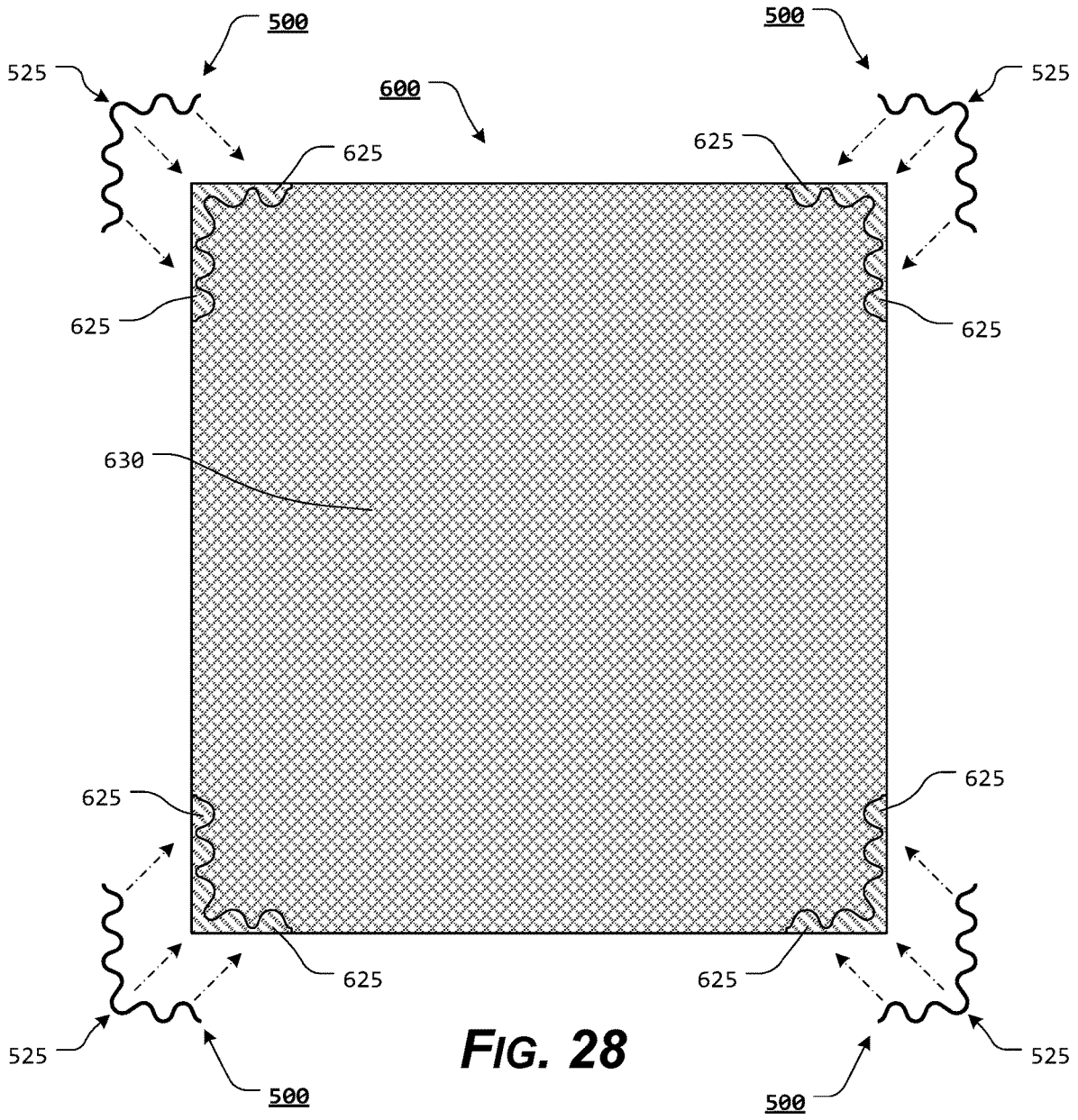
FIG. 28 illustrates a bottom view of exemplary embodiments of offset scored corrugated corner elements aligned with an exemplary embodiment of a tray or endcap element, according to the present disclosure.
Figure 29:
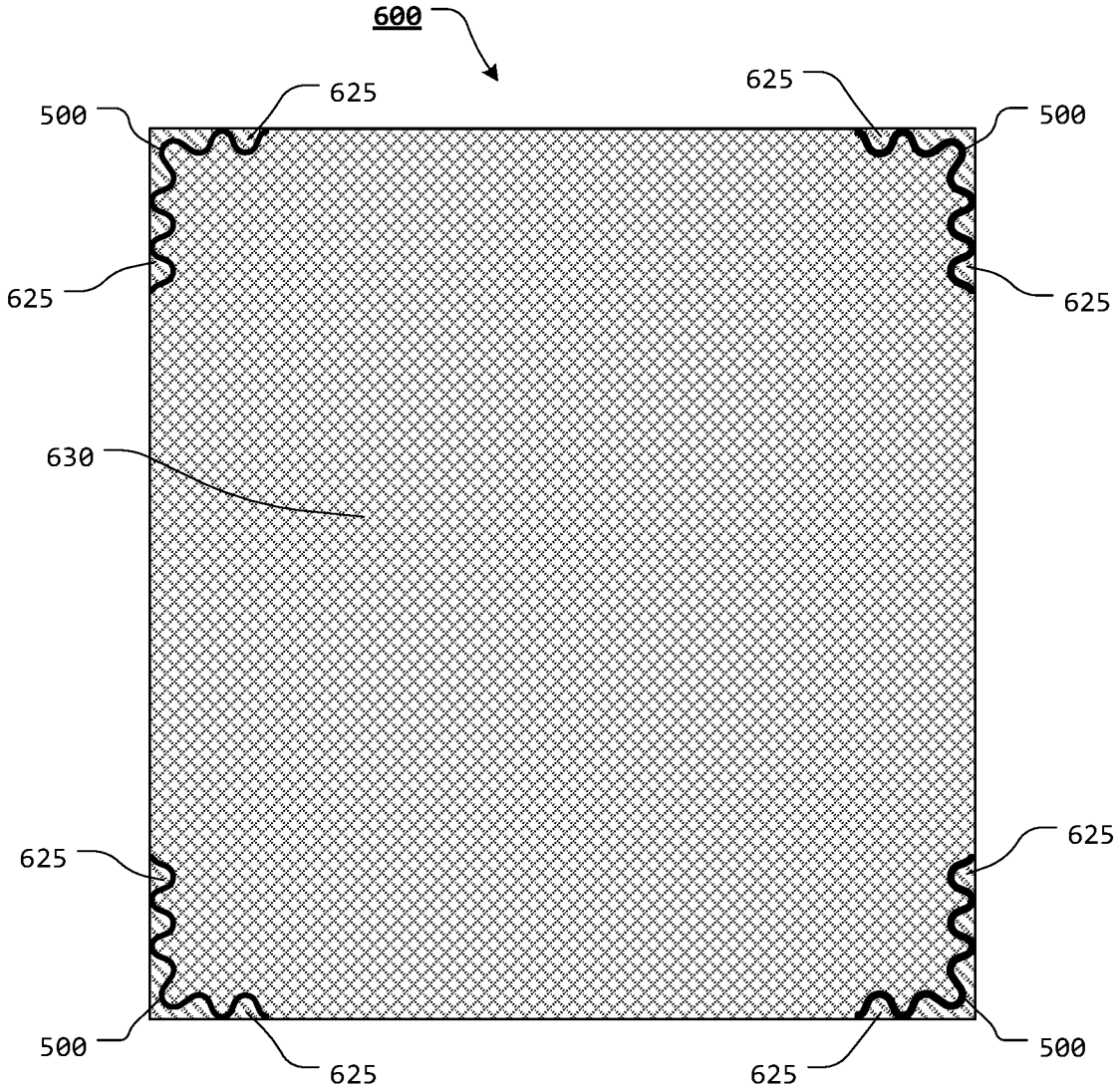
FIG. 29 illustrates a bottom view of exemplary embodiments of offset scored corrugated corner elements assembled with an exemplary embodiment of a tray or endcap element, according to the present disclosure.

By bending or folding the scored corrugated corner element 100 along the score mark 125, as illustrated by the semicircular arrows in FIG. 6, a portion of the scored corrugated corner element 100 can be more easily manipulated to the more flattened position, as illustrated in FIG. 7. In certain embodiments, a plurality of score marks 125 may be formed at spaced apart locations extending substantially parallel to the longitudinal axis, $A_L$, of the scored corrugated corner element 100.

By optionally positioning the score mark 125 proximate the vertex 122, a single fold of the scored corrugated corner element 100 can allow the scored corrugated corner element 100 to be manipulated to a more flattened position. Once in the more flattened position, scored corrugated corner elements 100 can be positioned atop one another and alternating ridges 126 of a first scored corrugated corner element 100 can be "nested" within at least a portion of certain alternating grooves 124 of a second scored corrugated corner element 100. Thus, the area required for each scored corrugated corner element is altered, to allow more scored corrugated corner elements 100 to be more densely packaged in a particular packaging container.

In certain exemplary embodiments, as illustrated most clearly in FIGS. 1-7, the score mark 125 may optionally be formed proximate a center of the scored corrugated corner element 100, as defined between the first corner element end 128 and the second corner element end 129. Alternatively, the score mark 125 may optionally be formed in an area other than the proximate center of the scored corrugated corner element 100, more proximate the first corner element end 128 or the second corner element end 129.

In various exemplary embodiments, the scored corrugated corner element 100 is substantially rigid and is formed of cardboard. Alternate materials of construction of the scored corrugated corner element 100 may include one or more of the following: thick paper (of various types), pasteboard, paperboard, container board, corrugated fiberboard, box board, or chipboard. In still other exemplary embodiments, alternate materials of construction of the scored corrugated corner element 100 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the scored corrugated corner element 100 is a design choice based on the desired appearance and functionality of the scored corrugated corner element 100 and/or the packaging assembly 300.

The scored corrugated corner element 100 may be constructed having an any desired overall size or shape. It should also be understood that the overall size and shape of the scored corrugated corner element 100, and the various portions thereof, is a design choice based upon the desired functionality, compatibility with desired articles or products and/or appearance of the scored corrugated corner element 100.

Thus, it should be appreciated that the overall length, width, and/or height of the first corner element leg 110 and the second corner element leg 112 is a design choice, based upon the desired degree of packaging or cushioning provided by the scored corrugated corner element 100 and/or the size and shape of the packaged article or product 400 with which the scored corrugated corner element 100 is to be utilized.

In certain exemplary, nonlimiting embodiments, at least a portion of the outer wall 120 and/or the inner wall 130 may be textured or may include an adhesive portion to provide a surface or area having a desired degree of friction or adhesive bonding relative to a product or product packaging. Thus, at least a portion of the scored corrugated corner element 100 may be formed so as to resist movement of the scored corrugated corner element 100 relative to a surface.

As illustrated most clearly in FIGS. 8-12, each endcap element 200 generally comprises at least one partial tray layer 210 and/or full tray layer 220 attached or coupled to at least one support layer 230. Each partial tray layer 210 includes an elongate portion of material having a top surface 211 and a bottom surface 212. Each full tray layer 220 includes an elongate portion of material having a top surface 221 and a bottom surface 222. Each support tray layer 230 includes an elongate portion of material having a top surface 231 and a bottom surface 232. However, it should be appreciated that each endcap element 200 may be formed or built up utilizing any number and/or combination of partial tray layers 210, full tray layers 220, and/or support layers 230.

In various exemplary embodiments, adjacent surfaces of the partial tray layer 210, full tray layer 220, and/or support layer 230 may optionally be bonded together, such as, by adhesives, forming adhesive layers 280. Alternatively, portions of the partial tray layer 210, full tray layer 220, and/or support layer 230 may optionally be attached, coupled, fastened, or secured to one another, mechanically (i.e., via nails, screws, rivets, pins, or other fasteners) or as otherwise known in the art.

In certain exemplary, nonlimiting embodiments, each full tray layer 220 extends to four corners. However, it should be understood that the number of corners of the full tray layer 220 is a design choice, dictated primarily by an upper or lower footprint of an article or product 400 that is to be contained or packaged within the packaging assembly 300.

It should also be appreciated that certain indents, recesses, or depressions may be formed in at least portions of the partial tray layer 210, the full tray layer 220, and/or the support layer 230 to accommodate and/or further secure a packaged article or product 400 within the packaging assembly 300.

A corner recess 225 is formed in a portion of the at least one partial tray layer 210 and/or the at least one support layer 230. Each corner recess 225 is formed proximate each corner of the at least one partial tray layer 210 and/or full tray layer 220. In this manner, when the partial tray layer 210, the full tray layer 220 and/or the support layer 230 are attached or coupled to form the endcap element 200, corner portions of at least the partial tray layer 210 extend beyond the corner recesses 225 formed in the partial tray layers 210 and/or the support layers 230.

Each corner recess 225 is formed so as to matingly engage at least a portion of the first terminal end 101 or the second terminal end 102 of one of the scored corrugated corner elements 100 at least partially therein. Each corner recess 225 forms an extending substantially parallel curve, mating, or matingly offset curve of the inner wall 130 of at least a first terminal end 101 or a second terminal end 102 of each of the scored corrugated corner elements 100 to form a mating surface for the inner wall 130 of at least a first terminal end 101 or a second terminal end 102 of each of the scored corrugated corner elements 100. Generally, each corner recess 225 is formed so as to substantially abut the inner wall 130 of at least a first terminal end 101 or a second terminal end 102 of each of the scored corrugated corner elements 100. Thus, each corner recess 225 includes one or more concave scallop(s) or alternating ridges and grooves cut out of the ends that allows a multi-scored corrugated corner element 100 to be located planarly by interlocking with the sinusoidal or other interior shape of the accompanying scored corrugated corner element 100.

In various exemplary embodiments, one or more of the partial tray layer 210, the full tray layer 220 and/or the support layer 230 is substantially rigid and is formed of cardboard. Alternate materials of construction of the partial tray layer 210, the full tray layer 220 and/or the support layer 230 may include one or more of the following: thick paper (of various types), pasteboard, paperboard, container board, corrugated fiberboard, box board, or chipboard. In still other exemplary embodiments, alternate materials of construction of the partial tray layer 210, the full tray layer 220 and/or the support layer 230 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the partial tray layer 210, the full tray layer 220 and/or the support layer 230 is a design choice based on the desired appearance and functionality of the partial tray layer 210, the full tray layer 220 and/or the support layer 230 and/or the packaging assembly 300.

FIGS. 13-16 illustrate the basic assembly of the packaging assembly 300. As illustrated most clearly in FIGS. 13-16, a first tray or endcap element 200 is positioned generally below an article or product 400. A second tray or endcap element 200 is positioned generally atop the article or product 400.

In certain exemplary, nonlimiting embodiments, the tray or endcap elements 200 may be constructed having an International Organization for Standardization (ISO) sanctioned pallet dimension (i.e., 40.00"×48.00", 39.37"×47.24", 45.9"×45.9", 42.00"×42.00", 43.30"×43.30", or 31.50"×47.24"), a Grocery Manufacturers' Association (GMA) pallet dimension (i.e., 40"×48", 42"×42", 48"×48", 48"×40", 48"×42", 40"×40", 48"×45", 44"×44", 36"×36", 48"×36", 35"×45.5", or 48"×20"), a European pallet dimension (i.e., 31.50"×47.24", 47.24"×39.37", 39.37"×47.24", 31.50"×23.62", 23.62"×15.75", or 15.75"×11.81"), an Australian pallet dimension (i.e., 45.87"×45.87"), or any desired size or shape. It should also be understood that the overall size and shape of the tray or endcap elements 200 (and the resulting packaging assembly 300), and the various portions thereof, is a design choice based upon the desired functionality, compatibility with desired articles or products, and/or appearance of the packaging assembly 300.

In certain exemplary, nonlimiting embodiments, at least a bottom surface of the first tray or endcap element 200 may be textured to provide a surface having a desired degree of friction relative to a floor or other support surface. Thus, the bottom surface of the first tray or endcap element 200 (or a top surface of the second tray or endcap element 200) may be chosen so as to allow the packaging assembly 300 to resist movement relative to a floor or other surface or more easily slide across a floor or other surface.

When properly positioned, a corner portion of at least the partial tray layer 210 extends beyond at least a portion of the article or product 400. In various exemplary embodiments, the corner recesses 225 are formed so as to generally allow the scored corrugated corner elements 100 to be aligned with the corners of the partial tray layer 210.

The corner elements 100 are sized so as to be positioned within the corner recesses 225 of the spaced endcap elements 200. When positioned within the corresponding corner recesses 225. A terminal end of the second terminal end 102 abuts against the corner portion of at least a partial tray layer 210 of a bottom or first tray or endcap element 200. Likewise, a terminal end of the first terminal end 101 abuts against the corner portion of at least a partial tray layer 210 of a top or second tray or endcap element 200. In this manner, the terminal ends of the second terminal ends 102 of the corner elements 100 are supported by the bottom or first tray or endcap element 200 and the terminal ends of the first terminal ends 101 will the corner elements 100 support the top or second tray or endcap element 200. Thus, the packaged article or product 400 is maintained within the spaced endcap elements 200 and the scored corrugated corner elements 100.

Each corner recess 225 is formed so as to matingly engage at least a portion of the first terminal end 101 or the second terminal end 102 of one of the scored corrugated corner elements 100 at least partially therein. Each corner recess 225 forms an extending substantially parallel curve, mating, or matingly offset curve of the inner wall 130 of at least a first terminal end 101 or a second terminal end 102 of each of the scored corrugated corner elements 100 to form a mating surface for the inner wall 130 of at least a first terminal end 101 or a second terminal end 102 of each of the scored corrugated corner elements 100. Generally, each corner recess 225 is formed so as to substantially abut the inner wall 130 of at least a first terminal end 101 or a second terminal end 102 of each of the scored corrugated corner elements 100.

In various exemplary embodiments, opposing end portions of each corner recess 225 is formed so as to include a notch, groove, or other surface or surface preparation that allows at least a portion of the first corner element end 128 and the second corner element end 129 to be at least partially captured or frictionally engaged against the end portions of each corner recess 225. Thus, during installation, the scored corrugated corner elements 100 may be flexed inward, relative to the vertex 122, to be positioned within the respective corner recesses 225. Once appropriately positioned within the respective corner recesses 225, the natural resilience of the scored corrugated corner element 100, causes the scored corrugated corner element 100 to resiliently recover to or toward the original shape of the scored corrugated corner element 100. This provides frictional or captured engagement of the scored corrugated corner element 100 within the respective corner recess 225.

Once assembled, adjacent or abutted surfaces of the corner elements 100 and tray or endcap elements 200 may optionally be bonded together, such as, by adhesives. Alternatively, portions of the corner elements 100 and tray or endcap elements 200 may optionally be attached, coupled, fastened, secured, or bonded together, mechanically (i.e., vi, upon which a nails, screws, rivets, pins, or other fasteners) or as otherwise known in the art. In still other embodiments, the packaging assembly 300 may be wrapped in plastic or other material to further secure the corner elements 100 to the tray or endcap elements 200.

One or more apexes of alternating ridges 126 make contact portions of the surface of the interior of the product packaging and the packaged article or product 400 to maintain the packaged article or product 400 in a desired position relative to the product packaging and provide package cushioning or support to the packaged article or product 400 during shipping, transport, or storage.

During shipping, transport, or storage of the packaged article or product 400, the scored corrugated corner element 100 helps to resist movement of the packaged article or product 400 within the product packaging. Additionally, if the product packaging is bumped or jarred, causing the packaged article or product 400 to shift within the product packaging, the alternating ridges 126 and grooves 124 allow for a degree of inward and/or outward flexion and resilient recovery toward the original shape of the scored corrugated corner element 100.

It should be appreciated that the scored corrugated corner elements, the tray or endcap elements, and/or the packaging assembly of the present disclosure is not limited to the embodiments illustrated and described in FIGS. 1-16. For example, FIGS. 17-31 illustrate certain components, elements, and/or aspects of certain exemplary embodiments of offset scored corrugated corner elements 500 and tray or endcap elements 600 that may optionally be used to form the packaging assembly 300, according to the present disclosure.

As illustrated in FIGS. 17-31, the offset scored corrugated corner elements 500 comprise an elongate portion of material or a sheet 505, extending substantially parallel to a longitudinal axis, $A_L$, from a first terminal end 501 to a second terminal end 502 and extending substantially perpendicular to said longitudinal axis, $A_L$, from a first corner element end 528 to a second corner element end 529, a vertex 522, a first corner element leg 510, a second corner element leg 512, an outer wall 520, an inner wall 530, one or more alternating ridges 526 and/or grooves 524, and an optional score mark 525.

It should be appreciated that these elements correspond to and operate similarly to the sheet 105, the first terminal end 101, the second terminal end 102, the first corner element end 128, the second corner element end 129, the vertex 122, the first corner element leg 110, the second corner element leg 112, the outer wall 120, the inner wall 130, the one or more alternating ridges 126 and/or grooves 124, and the optional score mark 125, as described herein, with reference to the scored corrugated corner elements 100.

The tray or endcap elements 600 generally comprise at least one partial tray layer 610 having a top surface 611 and a bottom surface 612 and/or full tray layer 620 having a top surface 621 and a bottom surface 622, at least one support layer 630 having a top surface 631 and a bottom surface 632.

It should also be appreciated that these elements correspond to and operate similarly to the at least one partial tray layer 210, the top surface 211, the bottom surface 212, the full tray layer 220, the top surface 221, the bottom surface 222, the at least one support layer 230, the top surface 231, and the bottom surface 232, as described herein, with reference to the tray or endcap elements 200.

However, as illustrated FIGS. 17-31, the vertex 522 of the offset scored corrugated corner element 500 is not formed along a proximate a center of the offset scored corrugated corner elements 500 (defining a first corner element leg 510 having a substantially equal length as the second corner element leg 512). Instead, the vertex 522 is formed closer to the first corner element end 528 than the second corner element end 529. Thus, the length of the first corner element leg 510 (as measured between the first corner element end 528 and the vertex 522) is less than the length of the second corner element leg 512 (as measured between the second corner element end 529 and the vertex 522).

Thus, the vertex 522 is formed offset from the center of the offset scored corrugated corner element 500 such that the offset scored corrugated corner element 500 is generally "L" shaped, while the scored corrugated corner element 100 is generally "V" shaped, by comparison.

It should also be appreciated that the offset scored corrugated corner elements 500 may be formed such that the vertex 522 is formed closer to the second corner element end 529 than the first corner element end 528. Thus, the length of the first corner element leg 510 (as measured between the first corner element end 528 and the vertex 522) may optionally be greater than the length of the second corner element leg 512 (as measured between the second corner element end 529 and the vertex 522).

In these exemplary embodiments, the score mark 525 is formed proximate or along the vertex 522.

The score mark 525 provides a line or portion along which the offset scored corrugated corner element 500 may be comparatively more easily bent or folded, whether along the grain or against the grain of the offset scored corrugated corner element 500 or the sheet 505. Thus, the score mark 525 may optionally provide a compressed or weakened area or portion of the offset scored corrugated corner element 500, along which the offset scored corrugated corner element 500 may be comparatively more easily bent or folded.

Figure 30:
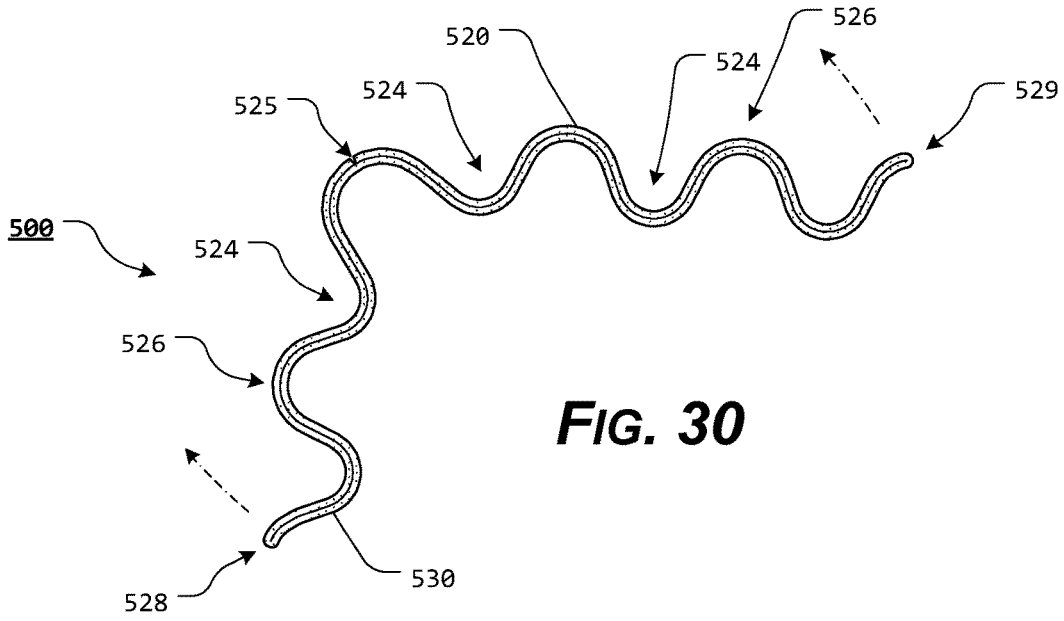
FIG. 30 illustrates a top view of an exemplary embodiment of an offset scored corrugated corner element, according to the present disclosure.
Figure 31:
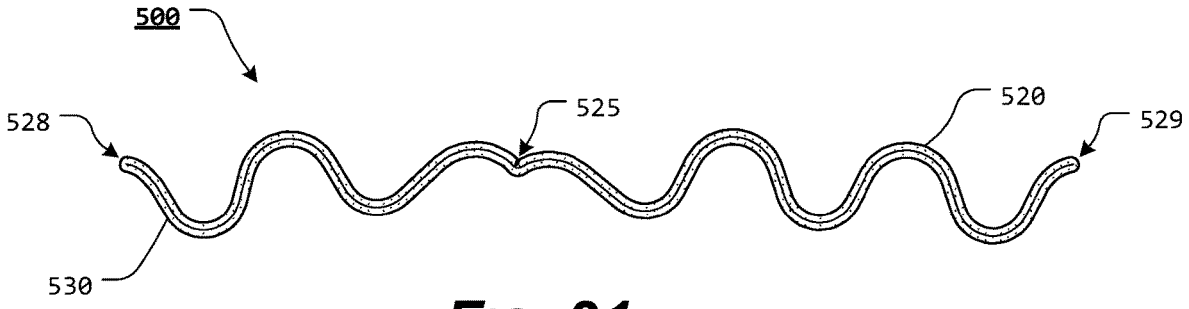
FIG. 31 illustrates a bottom view of an exemplary embodiment of an offset scored corrugated corner element, according to the present disclosure.

By bending or folding the offset scored corrugated corner element 500 along the score mark 525, as illustrated by the semicircular arrows in FIG. 30, a portion of the offset scored corrugated corner element 500 can be more easily manipulated to the more flattened position, as illustrated in FIG. 31.

Each corner recess 625 is formed in a portion of the at least one partial tray layer 610 and/or the at least one support layer 630. Each corner recess 625 is formed proximate each corner of the at least one partial tray layer 610 and/or full tray layer 620. In this manner, when the partial tray layer 610, the full tray layer 620 and/or the support layer 630 are attached or coupled to form the endcap element 600, corner portions of at least the partial tray layer 610 extend beyond the corner recesses 625 formed in the partial tray layers 610 and/or the support layers 630.

In a fashion similar to the corner recesses 225, each corner recess 625 is formed so as to matingly engage at least a portion of the first terminal end 501 or the second terminal end 502 of one of the offset scored corrugated corner elements 500 at least partially therein. Each corner recess 625 forms an extending substantially parallel curve, mating, or matingly offset curve of the inner wall 530 of at least a first terminal end 501 or a second terminal end 502 of each of the offset scored corrugated corner elements 500 to form a mating surface for the inner wall 530 of at least a first terminal end 501 or a second terminal end 502 of each of the offset scored corrugated corner elements 500. Generally, each corner recess 625 is formed so as to substantially abut the inner wall 530 of at least a first terminal end 501 or a second terminal end 502 of each of the offset scored corrugated corner elements 500. Thus, each corner recess 625 includes one or more concave scallop(s) or alternating ridges and grooves cut out of the ends that allows an offset scored corrugated corner element 500 to be located planarly by interlocking with the sinusoidal or other interior shape of the accompanying offset scored corrugated corner element 500.

The corner elements 500 may be utilized in conjunction with a first tray or endcap element 600 and a second tray or endcap element 600 to create a packaging assembly 300 for an article or product 400.

As illustrated in FIGS. 32-38, each multi-scored corrugated corner element 700 comprises an elongate portion of material or a sheet 705, extending substantially parallel to a longitudinal axis, $A_L$, from a first terminal end 701 to a second terminal end 702 and extending substantially perpendicular to said longitudinal axis, $A_L$, from a first corner element end 728 to a second corner element end 729, a vertex 722, a first corner element leg 710, a second corner element leg 712, an outer wall 720, an inner wall 730, one or more alternating ridges 726 and/or grooves 724, and a first score mark 725.

It should be appreciated that these elements correspond to and operate similarly to the sheet 505, the first terminal end 501, the second terminal end 502, the first corner element end 528, the second corner element end 529, the vertex 522, the first corner element leg 510, the second corner element leg 512, the outer wall 520, the inner wall 530, the one or more alternating ridges 526 and/or grooves 524, and the optional score mark 525, as described herein, with reference to the scored corrugated corner elements 500.

However, as illustrated FIGS. 32-38, the multi-scored corrugated corner element 700 includes a third corner element leg 713 extending from the second corner element leg 712. Thus, the multi-scored corrugated corner element 700 is generally "U" shaped, while the scored corrugated corner element 500 is generally "V" shaped, by comparison.

As illustrated, the second corner element leg 712 extends continuously, from the second corner element end 729 to the first score mark 725 (which is formed proximate or along the vertex 722), while the first corner element leg 710 extends continuously from the midline of the second corner element end 729, from the first score mark 725 to a second score mark 727. In various exemplary embodiments, the second score mark 727 is formed proximate or along a ridge 726.

In various exemplary, nonlimiting embodiments, the first corner element leg 710 extends continuously, substantially laterally from the midline of the second corner element end 729. Alternatively, a midline of the first corner element leg 710 may optionally extend between approximately 70° and 110° from the midline of the second corner element end 729.

The second score mark 727 provides a line or portion along which the multi-scored corrugated corner element 700 may be comparatively more easily bent or folded, whether along the grain or against the grain of the multi-scored corrugated corner element 700 or the sheet 705. Thus, the second score mark 727 may optionally provide a compressed or weakened area or portion of the multi-scored corrugated corner element 700, along which the multi-scored corrugated corner element 700 may be comparatively more easily bent or folded.

Figure 37:
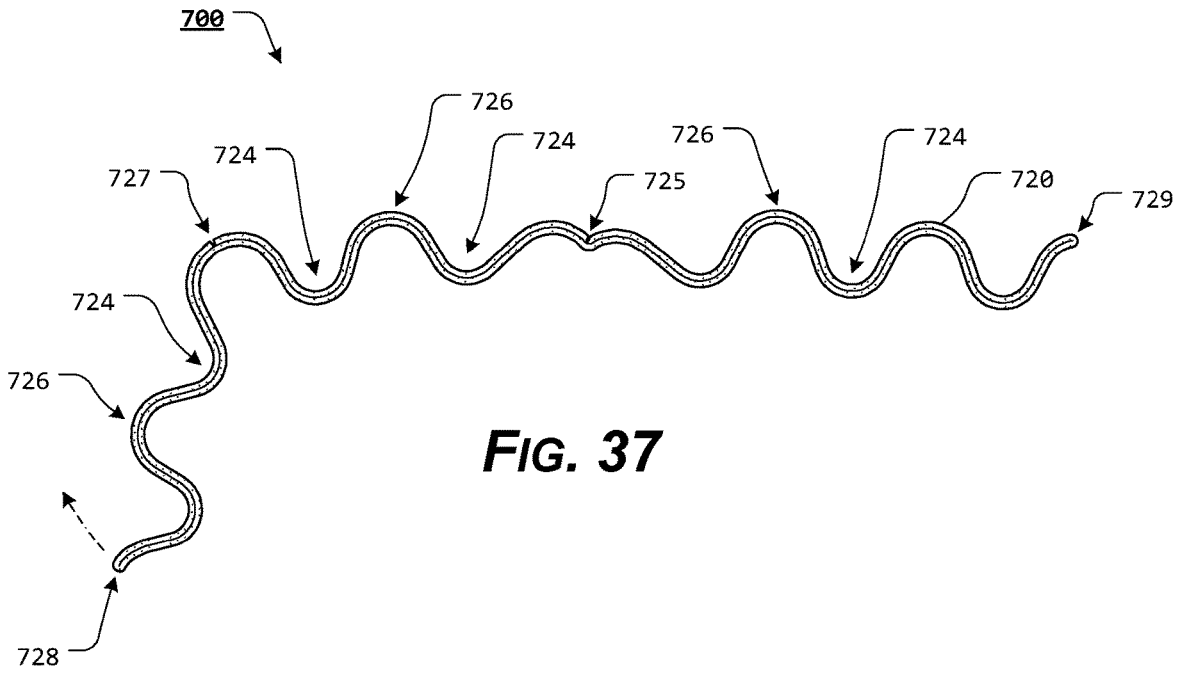
FIG. 37 illustrates a top view of an exemplary embodiment of a multi-scored corrugated corner element, according to the present disclosure.
Figure 38:
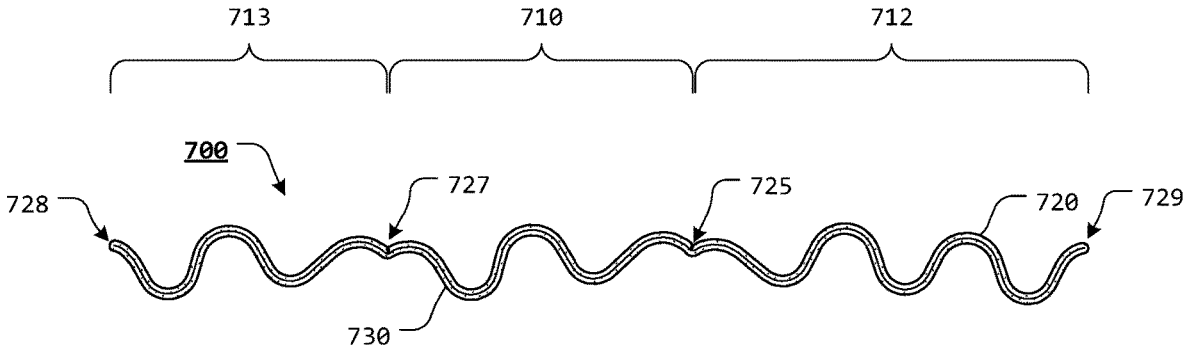
FIG. 38 illustrates a bottom view of an exemplary embodiment of a multi-scored corrugated corner element, according to the present disclosure.

By bending or folding the multi-scored corrugated corner element 700 along the second score mark 727, as illustrated by the semicircular arrows in FIG. 37, a portion of the multi-scored corrugated corner element 700 can be more easily manipulated to the more flattened position, as illustrated in FIG. 38.

As further illustrated, the third corner element leg 713 extends continuously from the midline of the first corner element leg 710, from the second score mark 727 to the first corner element end 728. In various exemplary embodiments, the second score mark 727 is formed proximate or along a ridge 726.

In various exemplary, nonlimiting embodiments, the third corner element leg 713 extends continuously, substantially laterally from the midline of the first corner element leg 710. Alternatively, a midline of the third corner element leg 713 may optionally extend between approximately 70° and 110° from the midline of the first corner element leg 710.

Figure 32:
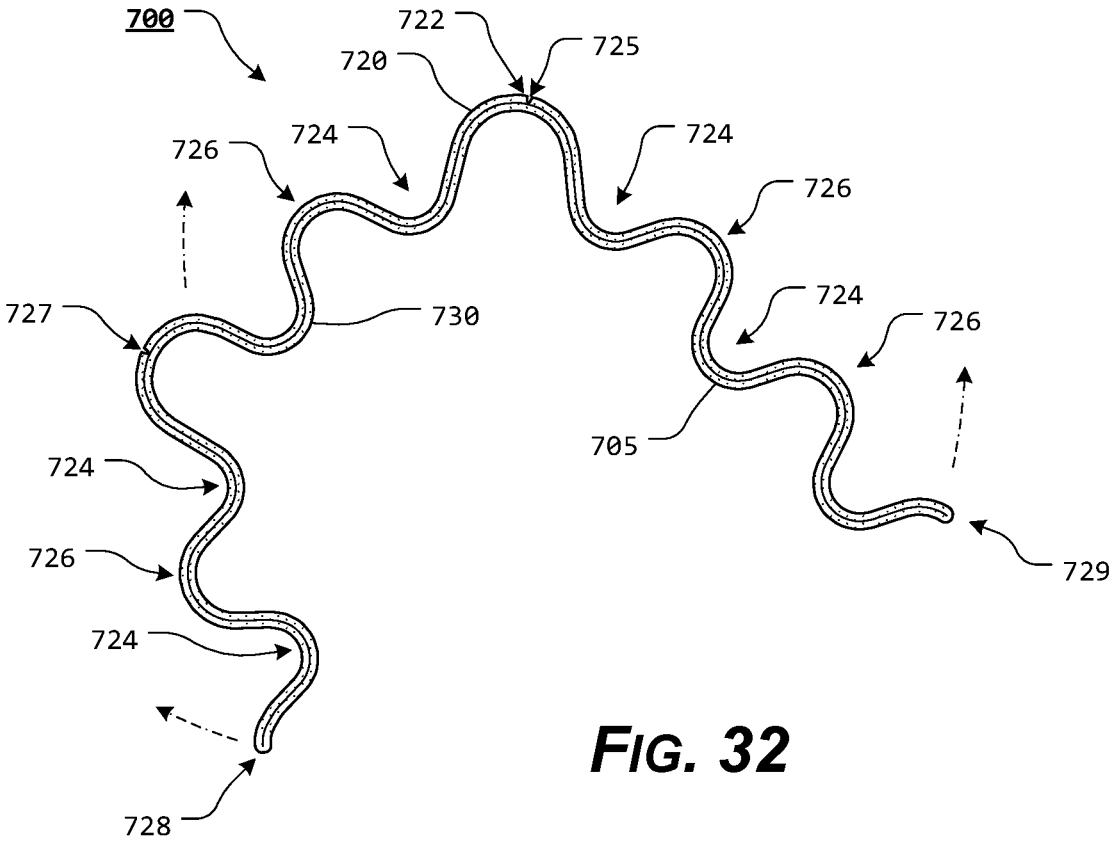
FIG. 32 illustrates a top view of an exemplary embodiment of a multi-scored corrugated corner element, according to the present disclosure.
Figure 33:
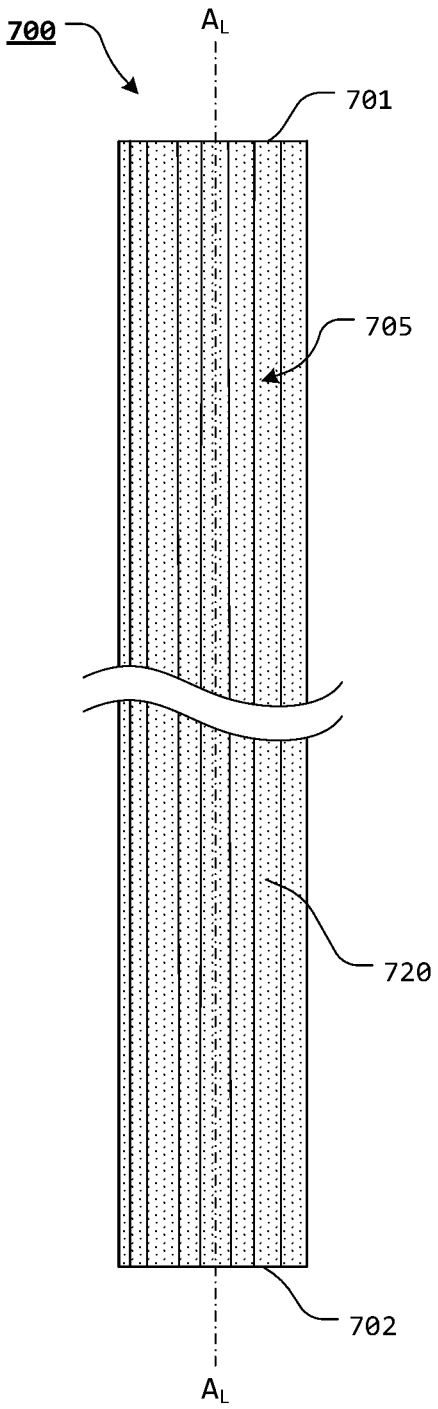
FIG. 33 illustrates a right side view of an exemplary embodiment of a multi-scored corrugated corner element, according to the present disclosure.
Figure 34:
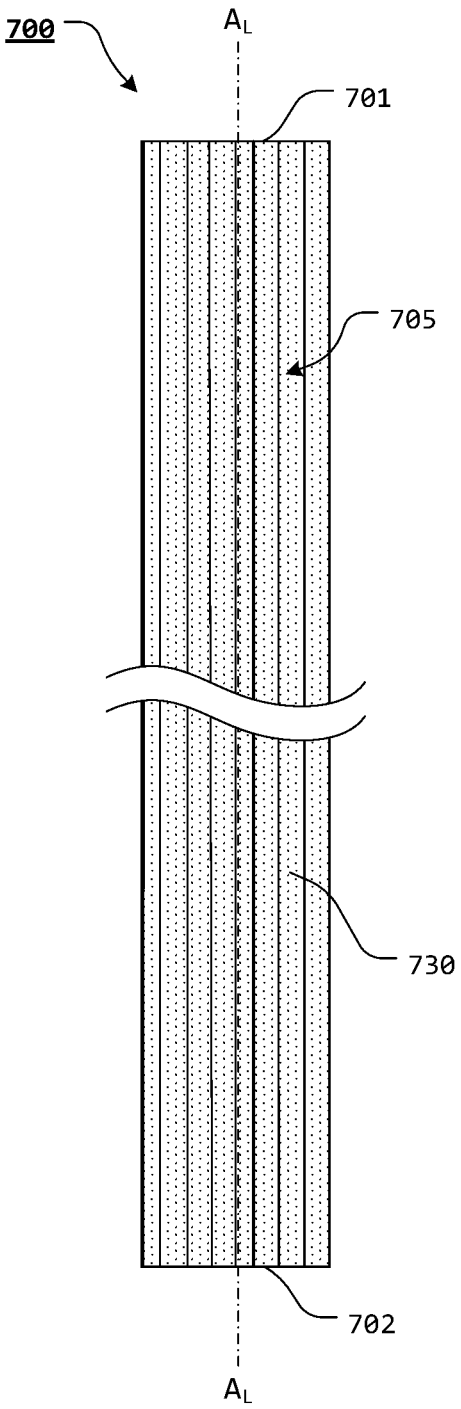
FIG. 34 illustrates a left side view of an exemplary embodiment of a multi-scored corrugated corner element, according to the present disclosure.
Figure 35:
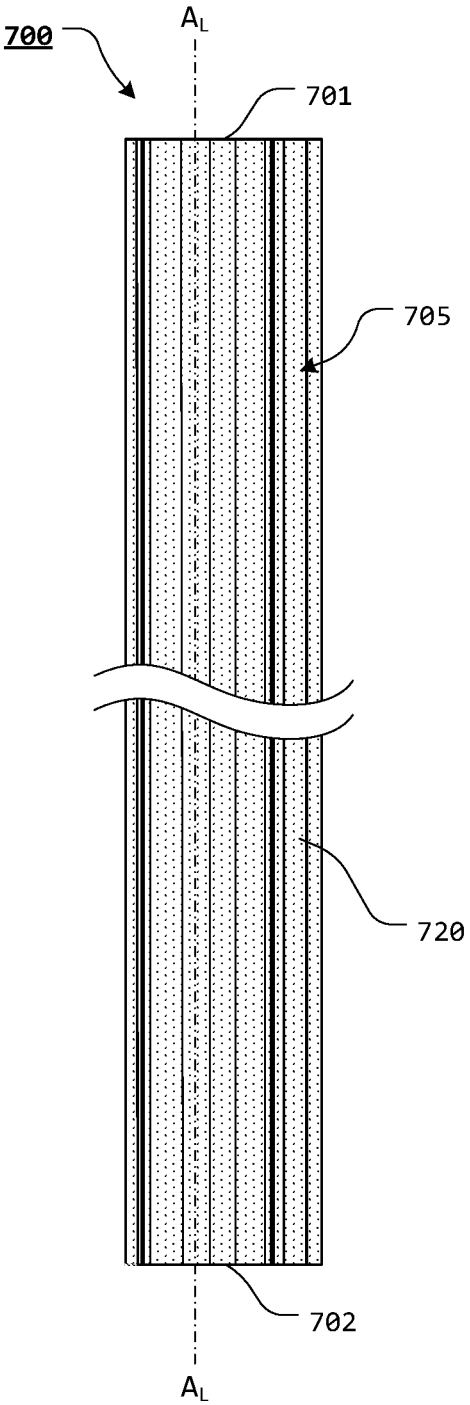
FIG. 35 illustrates a front view of an exemplary embodiment of a multi-scored corrugated corner element, according to the present disclosure.

Typically, when viewed from the top, as illustrated in FIG. 32, the sheet 705 includes one or more alternating ridges 726 and grooves 724, formed along its length. Each of the alternating ridges 726 and grooves 724 of the sheet 705 extends, extending substantially parallel to or extending substantially parallel to the longitudinal axis, $A_L$, of the scored corrugated corner elements 700. In certain exemplary, nonlimiting embodiments, each of the alternating ridges 726 and grooves 724 are extending substantially parallel and alternating ridges 726 and grooves 724.

By including the alternating ridges 726 and grooves 724, the sheet 705 is substantially curvilinear along its length, from the first corner element end 728 to the second corner element end 729. The alternating ridges 726 and grooves 724 may be formed such that the sheet 705 comprises a sinusoidal succession of waves or curves from the first corner element end 728 to the second corner element end 729. It should be appreciated that an amplitude and/or wavelength (i.e., a height and/or period) of the sinusoidal succession of waves or curves may be constant or may differ along the length of the sheet 705.

In various exemplary embodiments, the first score mark 725 and the second score mark 727 are formed such that a length of the first corner element leg 710, a length of the second corner element leg 712, and a length of the third corner element leg 713 are substantially equal. Alternatively, the first score mark 725 may optionally be formed closer to the second corner element end 729, such that the length of the second corner element leg 712, is less than the length of the first corner element leg 710 and/or the length of the third corner element leg 713. In other exemplary embodiments, the second score mark 727 may optionally be formed closer to the first corner element end 728, such that the length of the third corner element leg 713, is less than the length of the first corner element leg 710 and/or the length of the second corner element leg 712. In still other exemplary embodiments, the first score mark 725 and the second score mark 727 may optionally be formed comparatively close to the second corner element end 729 and the first corner element end 728, respectively, such that the length of the first corner element leg 710 is greater than the length of the third corner element leg 713 and the length of the second corner element leg 712.

Thus, it should be appreciated that the first score mark 725 and the second score mark 727 may optionally be formed such that the respective lengths of each of the first corner element leg 710 (as measured between the first score mark 725 and the second score mark 727), the second corner element leg 712 (as measured between the first score mark 725 and the second corner element end 729), and the third corner element leg 713 (as measured between the second score mark 727 and the first corner element end 728) may optionally be equal to, greater than, or less than one another.

Figure 36:
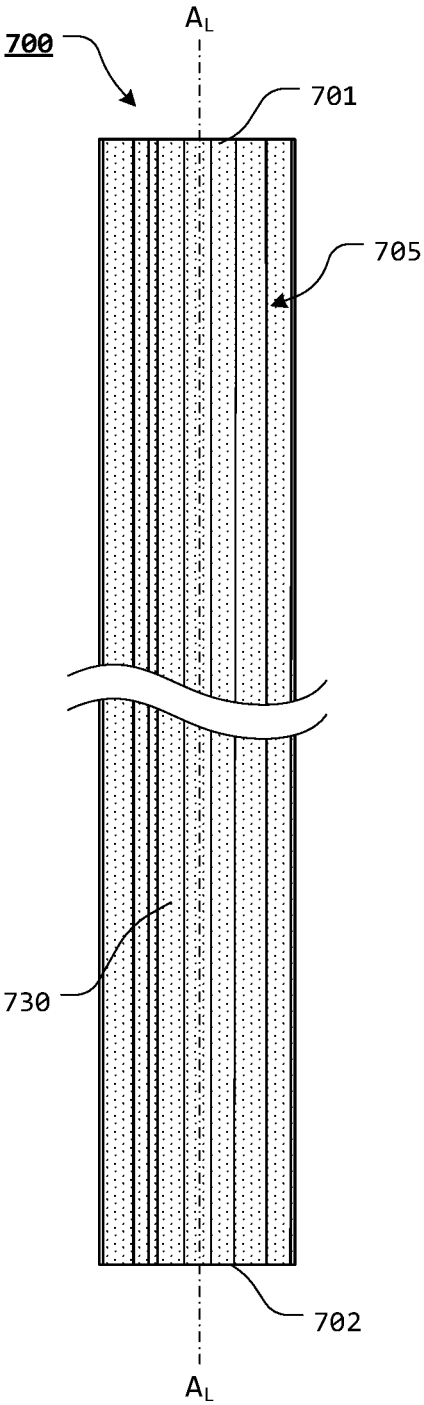
FIG. 36 illustrates a rear view of an exemplary embodiment of a multi-scored corrugated corner element, according to the present disclosure.

For packaging and/or shipping purposes, or when not in use, the multi-scored corrugated corner element 700 may be bent or folded along each of the first score mark 725 and the second score mark 727, as illustrated by the semicircular arrows in FIGS. 36 and 37, to more easily manipulate portions of the multi-scored corrugated corner element 700 to the more flattened position, as illustrated in FIG. 38. It should be appreciated that, even in the more flattened position, a general pattern of alternating ridges 726 and grooves 724 is maintained.

It should be appreciated that the multi-scored corrugated corner element 700 may be utilized in connection with endcap elements having appropriate mating corner recesses that allow a multi-scored corrugated corner element 700 to be located planarly by interlocking with the sinusoidal or other interior shape of the accompanying multi-scored corrugated corner element 700.

The multi-scored corrugated corner element 700 may be utilized in conjunction with a first tray or endcap element and a second tray or endcap element to create a packaging assembly for an article or product.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so drafted to require singular elements or exclude any optional element indicated to be so here in the text or drawings. This statement is

What is claimed is:

1. A multi-scored corrugated corner element, comprising:

a portion of material extending continuously, substantially parallel to a longitudinal axis, from a first terminal end to a second terminal end, wherein said portion of material extends continuously, substantially perpendicular to said longitudinal axis, from a first corner element end to a second corner element end;

a first score mark formed in said portion of material, extending substantially parallel to said longitudinal axis, wherein said first score mark provides a line or portion along which said corrugated corner element may be bent or folded such that said corrugated corner element may be more easily manipulated to a more flattened position;

a second score mark formed in said portion of material, extending substantially parallel to said longitudinal axis, wherein said second score mark provides a line or portion along which said corrugated corner element may be bent or folded such that said corrugated corner element may be more easily manipulated to a more flattened position, wherein said second score mark is formed at a spaced apart location from said first score mark;

a first corner element leg, extending between said first score mark and said second score mark, said first corner element leg having one or more alternating ridges and grooves, each of said alternating ridges and grooves of said first corner element leg extending substantially parallel to said longitudinal axis of said corrugated corner element;

a second corner element leg, extending between said first score mark and said second corner element end, said second corner element leg having one or more alternating ridges and grooves, each of said alternating ridges and grooves of said second corner element leg extending substantially parallel to said longitudinal axis of said corrugated corner element; and a third corner element leg, extending between said second score mark and said first corner element end, said third corner element leg having one or more alternating ridges and grooves, each of said alternating ridges and grooves of said third corner element leg extending substantially parallel to said longitudinal axis of said corrugated corner element.

2. The multi-scored corrugated corner element of claim 1, wherein said portion of material is a sheet material.

3. The multi-scored corrugated corner element of claim 1, wherein said first score mark and said second score mark are formed such that a length of said first corner element leg, a length of said second corner element leg, and a length of said third corner element leg are substantially equal.

4. The multi-scored corrugated corner element of claim 1, wherein said first score mark and said second score mark are formed such that a length of said first corner element leg is greater than a respective length of said second corner element leg and/or a respective length of said third corner element leg.

5. The multi-scored corrugated corner element of claim 1, wherein said first score mark and said second score mark are formed such that a length of said second corner element leg is greater than a respective length of said first corner element leg and/or a respective length of said third corner element leg.

6. The multi-scored corrugated corner element of claim 1, wherein said first score mark and said second score mark are formed such that a length of said third corner element leg is greater than a respective length of said first corner element leg and/or a respective length of said second corner element leg.

7. The multi-scored corrugated corner element of claim 1, wherein an outer wall of said corrugated corner element is substantially coextensive with an inner wall of said corrugated corner element.

8. The multi-scored corrugated corner element of claim 1, wherein each of said alternating ridges and grooves of said first corner element leg are alternating ridges and grooves, extending substantially parallel to a vertex.

9. The multi-scored corrugated corner element of claim 1, wherein each of said alternating ridges and grooves of said second corner element leg are alternating ridges and grooves, extending substantially parallel to a vertex.

10. The multi-scored corrugated corner element of claim 1, wherein each of said alternating ridges and grooves of said third corner element leg are alternating ridges and grooves, extending substantially parallel to a vertex.

11. The multi-scored corrugated corner element of claim 1, wherein said first corner element leg, said second corner element leg, and said third corner element leg are each curvilinear along a respective length.

12. The multi-scored corrugated corner element of claim 1, wherein an inner wall of said portion of material comprises a sinusoidal succession of waves or curves.

13. The multi-scored corrugated corner element of claim 1, wherein said first score mark and said second score mark are each formed of a complete or partial recess or depression in said portion of material.

14. The multi-scored corrugated corner element of claim 1, wherein said first score mark and said second score mark are each formed of a complete or partial perforation in said portion of material.

15. The multi-scored corrugated corner element of claim 1, wherein said first score mark and said second score mark are each formed in a portion of an outer wall or exterior surface of said portion of material.

16. The multi-scored corrugated corner element of claim 1, wherein said portion of material comprises a single layer of material.

17. The multi-scored corrugated corner element of claim 1, wherein said portion of material comprises a multi-layer portion of material.

18. A multi-scored corrugated corner element, comprising:

a portion of material extending substantially parallel to a longitudinal axis, from a first terminal end to a second terminal end, wherein said portion of material extends substantially perpendicular to said longitudinal axis, from a first corner element end to a second corner element end;

a first score mark formed in said portion of material, wherein said first score mark provides a line or portion along which said corrugated corner element may be bent or folded;

a second score mark formed in said portion of material, wherein said second score mark provides a line or portion along which said corrugated corner element may be bent or folded, wherein said second score mark is formed at a spaced apart location from said first score mark;

a first corner element leg, extending between said first score mark and said second score mark, said first corner element leg having one or more alternating ridges and grooves, each of said alternating ridges and grooves of said first corner element leg extending substantially parallel to said longitudinal axis of said corrugated corner element;

a second corner element leg, extending between said first score mark and said second corner element end, said second corner element leg having one or more alternating ridges and grooves, each of said alternating ridges and grooves of said second corner element leg extending substantially parallel to said longitudinal axis of said corrugated corner element; and a third corner element leg, extending between said second score mark and said first corner element end, said third corner element leg having one or more alternating ridges and grooves, each of said alternating ridges and grooves of said third corner element leg extending substantially parallel to said longitudinal axis of said corrugated corner element.

19. The multi-scored corrugated corner element of claim 18, wherein said first score mark and said second score mark each provide a line or portion along which said corrugated corner element may be more easily manipulated to a more flattened position.

20. A multi-scored corrugated corner element, comprising:

a portion of material extending from a first terminal end to a second terminal end and from a first corner element end to a second corner element end;

a first score mark formed in said portion of material to provide a line or portion along which said corrugated corner element may be more easily manipulated;

a second score mark formed in said portion of material to provide a line or portion along which said corrugated corner element may be more easily manipulated, wherein said second score mark is formed at a spaced apart location from said first score mark;

a first corner element leg extending from said first score mark to said second score mark and having one or more alternating ridges and grooves extending substantially parallel to said longitudinal axis of said corrugated corner element;

a second corner element leg extending from said first score mark to said second corner element end and having one or more alternating ridges and grooves extending substantially parallel to said longitudinal axis of said corrugated corner element; and a third corner element leg extending from said second score mark to said first corner element end and having one or more alternating ridges and grooves extending substantially parallel to said longitudinal axis of said corrugated corner element.

* * * * *